US009796398B2

(12) United States Patent
Mizobata et al.

(10) Patent No.: US 9,796,398 B2
(45) Date of Patent: Oct. 24, 2017

(54) AIR-CONDITIONING APPARATUS AND RAILWAY VEHICLE AIR-CONDITIONING APPARATUS

(75) Inventors: Junpei Mizobata, Tokyo (JP); Wahei Shingu, Tokyo (JP); Kenji Yano, Tokyo (JP); Atsushi Nagata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 673 days.

(21) Appl. No.: 14/371,459

(22) PCT Filed: Feb. 2, 2012

(86) PCT No.: PCT/JP2012/000700

§ 371 (c)(1),
(2), (4) Date: Jul. 10, 2014

(87) PCT Pub. No.: WO2013/114461

PCT Pub. Date: Aug. 8, 2013

(65) Prior Publication Data

US 2014/0352338 A1 Dec. 4, 2014

(51) Int. Cl.
*G05D 23/32* (2006.01)
*F25B 13/00* (2006.01)
(Continued)

(52) U.S. Cl.
CPC ..... *B61D 27/0018* (2013.01); *F25B 13/00* (2013.01); *F25B 30/02* (2013.01);
(Continued)

(58) Field of Classification Search
CPC .... F25B 2313/02741; F25B 2313/0292; F25B 2500/27; F25B 2600/2519; F25B 2700/1933
(Continued)

(56) References Cited

U.S. PATENT DOCUMENTS 5,076,067 A * 12/1991 Prenger ..... F04C 28/28 417/32
5,630,323 A * 5/1997 Niijima ..... F25B 41/04 62/158
(Continued)

FOREIGN PATENT DOCUMENTS

JP 62-228846 A 10/1987
JP 62-233655 A 10/1987
(Continued)

OTHER PUBLICATIONS

Extended European Search Report dated Dec. 15, 2015 in the corresponding EP Application No. 12867535.2.
(Continued)

*Primary Examiner* — Henry Crenshaw
(74) *Attorney, Agent, or Firm* — POSZ LAW GROUP, PLC

(57) ABSTRACT

An air-conditioning apparatus includes a compressor, a four-way valve, expansion means, and an indoor heat exchanger, and further includes a check valve disposed between a discharge side of the compressor and the four-way valve, a first solenoid valve disposed between the expansion means and the indoor heat exchanger, and a controller. Opening and closing of the first solenoid valve are controllable. The controller switches the four-way valve and switches the first solenoid valve between open and closed states. When a heating operation is stopped, the controller switches the four-way valve from connection for the heating operation to connection for a cooling operation, closes the first solenoid valve, and then stops the compressor.

9 Claims, 16 Drawing Sheets

(51) Int. Cl.

| | |
|---|---|
| ***F25B 41/00*** | (2006.01) |
| ***F01C 1/02*** | (2006.01) |
| ***B61D 27/00*** | (2006.01) |
| ***F25B 30/02*** | (2006.01) |
| ***F25B 41/04*** | (2006.01) |
| ***F25B 49/02*** | (2006.01) |

(52) U.S. Cl.
CPC ..... *F25B 41/046* (2013.01); *F25B 49/02* (2013.01); *F25B 2313/0292* (2013.01); *F25B 2313/02741* (2013.01); *F25B 2500/27* (2013.01); *F25B 2600/2519* (2013.01); *F25B 2700/1933* (2013.01)

(58) Field of Classification Search
USPC ..... 418/55.1, 55.4; 62/158, 160, 196.3, 197
See application file for complete search history.

(56) References Cited

U.S. PATENT DOCUMENTS

| | | | | |
|---|---|---|---|---|
| 5,822,999 | A * | 10/1998 | Salo | F25B 41/04 62/196.3 |
| 2004/0098997 | A1* | 5/2004 | Lee | F25B 49/022 62/222 |
| 2006/0218947 | A1* | 10/2006 | Lifson | F25B 1/047 62/160 |
| 2007/0172374 | A1* | 7/2007 | Hasegawa | F01C 1/3564 418/63 |
| 2008/0193313 | A1* | 8/2008 | Sekiya | F04C 18/0223 418/55.4 |
| 2008/0219871 | A1* | 9/2008 | Yano | F04C 18/0223 418/55.1 |
| 2008/0276635 | A1* | 11/2008 | Terasaki | F25B 13/00 62/222 |
| 2009/0123315 | A1* | 5/2009 | Nakamura | F04C 18/0223 418/55.1 |

FOREIGN PATENT DOCUMENTS

| | | | |
|---|---|---|---|
| JP | 06-026716 | A | 2/1994 |
| JP | 08-166171 | A | 6/1996 |
| JP | H11-044296 | A | 2/1999 |
| JP | 2000-274745 | A | 10/2000 |
| JP | 2003-336688 | A | 11/2003 |
| JP | 2008-164227 | A | 7/2008 |
| JP | 2008-534911 | A | 8/2008 |
| JP | 2011-089737 | A | 5/2011 |
| JP | 2011-247489 | A | 12/2011 |
| WO | 2004/083744 | A1 | 9/2004 |
| WO | 2008/102748 | A1 | 8/2008 |

OTHER PUBLICATIONS

Office Action dated Aug. 21, 2015 in corresponding CN Patent Application No. 201280068830.7 (with English translation).
Office Action dated May 7, 2015 issued in corresponding JP patent application No. 2013-556032 (and English translation).
International Search Report of the International Searching Authority dated Mar. 13, 2012 for the corresponding international application No. PCT/JP2012/000700 (and English translation).

* cited by examiner

AIR-CONDITIONING APPARATUS AND RAILWAY VEHICLE AIR-CONDITIONING APPARATUS

CROSS REFERENCE TO RELATED APPLICATION

This application is a U.S. national stage application of International Patent Application No. PCT/JP2012/0000700 filed on Feb. 2, 2012, the contents of which are incorporated herein by reference.

TECHNICAL FIELD

The present invention relates to an air-conditioning apparatus and a railway vehicle air-conditioning apparatus, and more particularly, to suppressing the stagnation of a refrigerant.

BACKGROUND

While a compressor of an air-conditioning apparatus is stopped, a state where lubricating oil in the compressor has dissolved in a refrigerant in the compressor, called a "stagnation state", occurs in some cases. Since the lubricating oil has dissolved in the refrigerant in the stagnation state, poor lubrication may be caused in the compressor.

As an approach to suppressing the stagnation of a refrigerant, an air-conditioning apparatus has been proposed which includes a compressor, an outdoor heat exchanger, a solenoid valve disposed between the compressor and the outdoor heat exchanger, and a temperature-controllable expansion valve (see Patent Literature 1, for example).

Additionally, an operation control device for an air-conditioning apparatus has been developed which permits a refrigerant to be stored in a receiver tank, an indoor heat exchanger, and an outdoor heat exchanger before a compressor is stopped (see Patent Literature 2, for example).

Patent Literature

Patent Literature 1: Japanese Unexamined Patent Application Publication No. 2011-89737 (see FIG. 2, for example)

Patent Literature 2: Japanese Unexamined Patent Application Publication No. 6-26716 (see Paragraphs [0007] and [0027] to [0031], for example)

According to a technique disclosed in Patent Literature 1, opening and closing of the solenoid valve, the opening degree of expansion means, and turn-off of the compressor are set on the basis of turn-on or turn-off of the compressor, operating time of the compressor, outdoor air temperature, and the like to prevent the stagnation of the refrigerant. Unfortunately, control patterns may become complicated.

According to the technique disclosed in Patent Literature 1, outdoor air temperature detecting means is provided in consideration of an increase in the amount of refrigerant dissolved in the lubricating oil with decreasing outdoor air temperature. This may accordingly increase the number of components.

A technique disclosed in Patent Literature 2 can suppress the occurrence of a stagnation state caused by diluting lubricating oil in the compressor with a liquid refrigerant returned suddenly into the compressor. However, dissolution of the liquid refrigerant remaining in the compressor in the lubricating oil may fail to be suppressed. Consequently, the technique disclosed in Patent Literature 2 needs a heater or the like in order to suppress the dissolution of the refrigerant remaining in the compressor in the lubricating oil. This may accordingly increase power consumption during a standby mode of the air-conditioning apparatus.

SUMMARY

The present invention has been made to solve the above-described disadvantages and provides an air-conditioning apparatus capable of suppressing the stagnation of a refrigerant while achieving suppression of complication of control, suppression of an increase in the number of components, and a reduction in power consumption.

The present invention provides an air-conditioning apparatus that includes a compressor, a four-way valve, an outdoor heat exchanger, expansion means, and an indoor heat exchanger which are connected by refrigerant pipes to provide a refrigeration cycle, the apparatus further including a check valve disposed between a discharge side of the compressor and the four-way valve, a first solenoid valve disposed between the expansion means and the indoor heat exchanger, and a controller. Opening and closing of the first solenoid valve are controllable. The controller switches the four-way valve and switches the first solenoid valve between open and closed states. When a heating operation is stopped, the controller switches the four-way valve from connection for the heating operation to connection for a cooling operation, closes the first solenoid valve, and then stops the compressor.

In the air-conditioning apparatus according to the present invention, the four-way valve is switched from the connection for the heating operation to the connection for the cooling operation, the first solenoid valve is closed, and after that, the compressor is stopped. Thus, the apparatus can suppress the stagnation of a refrigerant while achieving suppression of complication of control, suppression of an increase in the number of components, and a reduction in power consumption.

DETAILED DESCRIPTION

Embodiments of the present invention will be described below with reference to the drawings.

Embodiment 1

Figure 1:
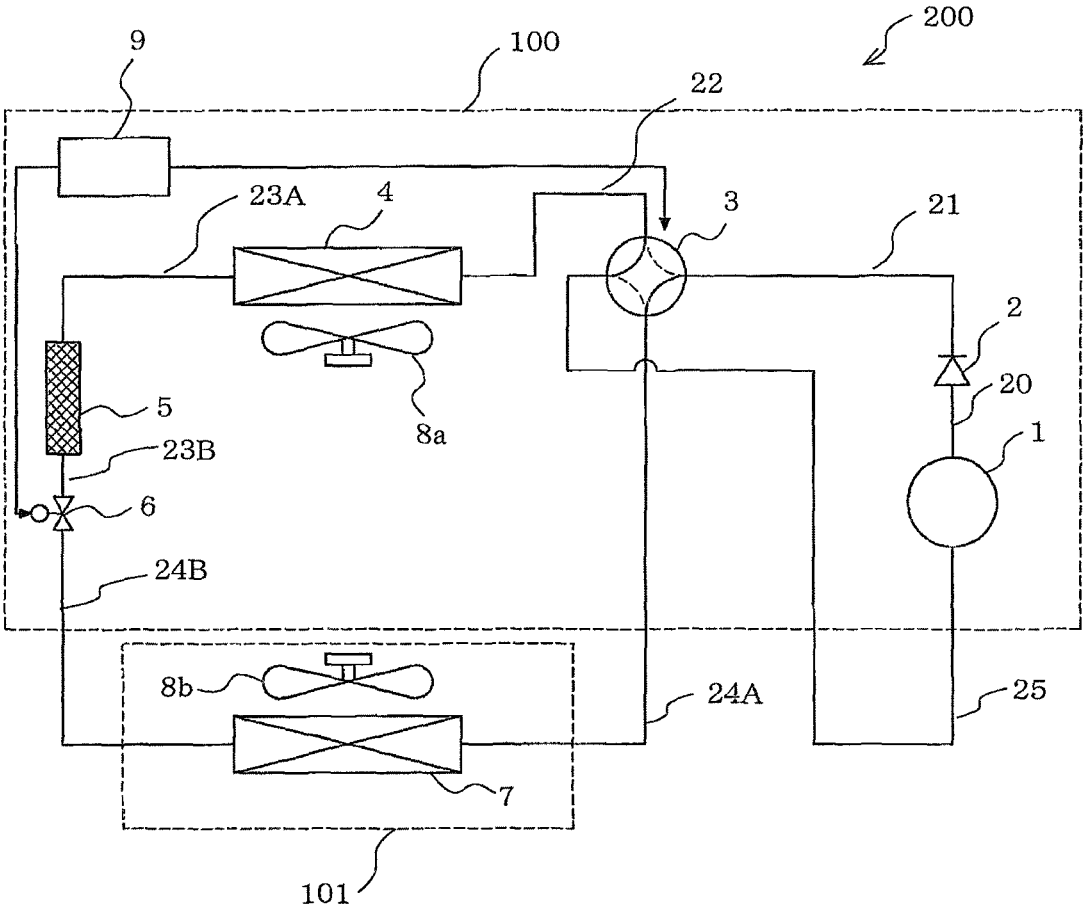
FIG. 1 illustrates an exemplary configuration of a refrigerant circuit of an air-conditioning apparatus according to Embodiment 1 of the present invention.

FIG. 1 illustrates an exemplary configuration of a refrigerant circuit of an air-conditioning apparatus 200 according to Embodiment 1.

The air-conditioning apparatus 200 according to Embodiment 1 is configured such that a refrigerant is separated from lubricating oil in a compressor.

[Configuration of Air-Conditioning Apparatus 200]

The air-conditioning apparatus 200 includes an outdoor unit 100 placed in, for example, an outdoor space, and an indoor unit 101 connected to the outdoor unit 100 by refrigerant pipes. The indoor unit 101 supplies conditioned air to an air-conditioning target space (e.g., an indoor space or a storehouse).

The outdoor unit 100 includes a compressor 1 that compresses the refrigerant and discharges the resultant refrigerant, a check valve 2 disposed on a discharge side of the compressor 1, a four-way valve 3 that switches between flow directions of the refrigerant, an outdoor heat exchanger 4 that functions as a condenser (radiator) during a cooling operation and functions as an evaporator during a heating operation, an air-sending device 8*a* that supplies air to the outdoor heat exchanger 4, expansion means 5 for reducing the pressure of the refrigerant, and a solenoid valve 6 connected to the expansion means 5.

The indoor unit 101 includes an indoor heat exchanger 7 that functions as an evaporator during the cooling operation and functions as a condenser during the heating operation, and an air-sending device 8*b* that supplies air to the indoor heat exchanger 7.

The air-conditioning apparatus 200 further includes, as refrigerant pipes, a compressor outlet pipe 20, a gas pipe 21, an outdoor pipe 22, a liquid pipe 23A, a connecting pipe 23B, a connecting pipe 24A, a connecting pipe 24B, and a compressor inlet pipe 25.

(Compressor 1)

The compressor 1 is configured to suck the refrigerant, compress the refrigerant into a high-temperature high-pressure state, and discharge the resultant refrigerant. The compressor 1 is connected at the refrigerant discharge side to the check valve 2 and is connected at a suction side to the four-way valve 3. More specifically, during the cooling operation, the discharge side of the compressor 1 is connected through the check valve 2 and the four-way valve 3 to the outdoor heat exchanger 4 and the suction side of the compressor 1 is connected through the four-way valve 3 to the indoor heat exchanger 7. During the heating operation, the discharge side of the compressor 1 is connected through the check valve 2 and the four-way valve 3 to the indoor heat exchanger 7 and the suction side of the compressor 1 is connected through the four-way valve 3 to the outdoor heat exchanger 4. The compressor 1 may be, for example, a capacity-controllable inverter compressor.

(Four-Way Valve 3)

The four-way valve 3 is configured to switch between the refrigerant flow direction during the heating operation and that during the cooling operation. During the heating operation, the four-way valve 3 connects the discharge side of the compressor 1 and the indoor heat exchanger 7 and connects the suction side of the compressor 1 and the outdoor heat exchanger 4. During the cooling operation, the four-way valve 3 connects the discharge side of the compressor 1 and the outdoor heat exchanger 4 and connects the suction side of the compressor 1 and the indoor heat exchanger 7.

Figure 3:
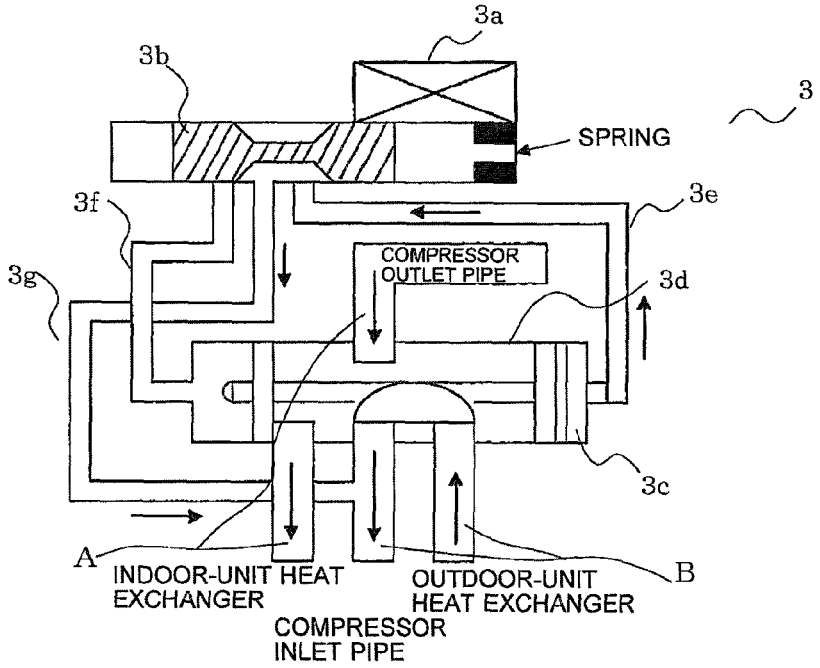
FIG. 3 is a diagram explaining the flow of the refrigerant in a four-way valve illustrated in FIG. 2 during the heating operation.

During the heating operation, the four-way valve 3 has a refrigerant passage A that connects the discharge side of the compressor 1 and the indoor heat exchanger 7 and a refrigerant passage B that connects the suction side of the compressor 1 and the outdoor heat exchanger 4 (see FIG. 3). During the cooling operation, the four-way valve 3 has a refrigerant passage C that connects the discharge side of the compressor 1 and the outdoor heat exchanger 4 and a refrigerant passage D that connects the suction side of the compressor 1 and the indoor heat exchanger 7 (see FIG. 5).

Figure 5:
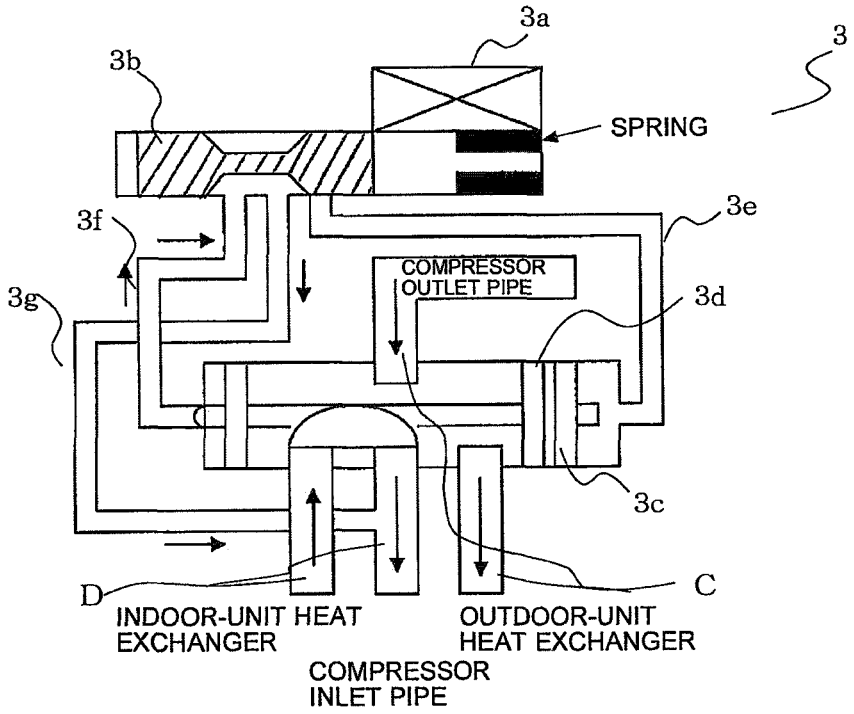
FIG. 5 is a diagram explaining the flow of the refrigerant in the four-way valve illustrated in FIG. 4 during the cooling operation.

The four-way valve 3 includes, as a mechanism for switching between the refrigerant flow direction during the heating operation and that during the cooling operation, a solenoid valve coil 3*a*, a needle valve 3*b*, a piston 3*c*, a cylinder 3*d*, and pipes 3*e* to 3*g* (see FIGS. 3 and 5). Energization of the solenoid valve coil 3*a* is controlled by a controller 9. The needle valve 3*b* is operated by the solenoid valve coil 3*a*. The piston 3*c* is moved by the pressure of the refrigerant. The cylinder 3*d* accommodates the piston 3*c*. Since the four-way valve 3 includes the above-described components, the solenoid valve coil 3*a* of the four-way valve 3 is energized, the needle valve 3*b* is shifted to a predetermined position, and the piston 3*c* is moved depending on the heating operation or the cooling operation. This allows switching between the refrigerant flow direction during the heating operation and that during the cooling operation.

(Outdoor Heat Exchanger 4, Air-Sending Device 8*a*)

The outdoor heat exchanger 4 (heat source side heat exchanger) is configured to exchange heat between the refrigerant and air sucked by the air-sending device 8*a* into the outdoor unit 100 such that the refrigerant condenses and liquefies during the cooling operation or evaporates and gasifies during the heating operation. The outdoor heat exchanger 4 is connected at a first end to the four-way valve 3 and is connected at a second end to the expansion means 5. The outdoor heat exchanger 4 may be, for example, a plate finned tube heat exchanger capable of exchanging heat between the refrigerant flowing through the refrigerant pipe and air passing between fins.

The air-sending device 8*a* is provided for, for example, the outdoor heat exchanger 4 and is configured to supply air for heat exchange with the refrigerant flowing through the outdoor heat exchanger 4. The air-sending device 8*a* includes a fan connected via, for example, a shaft and a motor for driving the fan.

(Expansion Means 5)

The expansion means 5 is configured to reduce the pressure of the refrigerant flowing through the refrigerant circuit such that the refrigerant is expanded. The expansion means 5 is connected at a first end to the outdoor heat exchanger 4 and is connected at a second end to the solenoid valve 6. The expansion means 5 may be a component having a variably controllable opening degree, for example, an electronic expansion valve.

(Solenoid Valve 6)

The solenoid valve 6 is a valve whose opening and closing are controlled by the controller 9 and which is capable of switching between passing and non-passing of the refrigerant through the valve. The solenoid valve 6 is connected at a first end to the connecting pipe 23B and is connected at a second end to the connecting pipe 24B.

(Indoor Heat Exchanger 7, Air-Sending Device 8*b*)

The indoor heat exchanger 7 (use side heat exchanger) is configured to exchange heat between the refrigerant and air sucked by the air-sending device 8*b* into the indoor unit 101 such that the refrigerant condenses and liquefies during the cooling operation or evaporates and gasifies during the heating operation. The indoor heat exchanger 7 is connected at a first end to the four-way valve 3 and is connected at a second end to the solenoid valve 6. The indoor heat exchanger 7 may be, for example, a plate finned tube heat exchanger capable of exchanging heat between the refrigerant flowing through the refrigerant pipe and air passing between fins.

The air-sending device 8*b* is provided for, for example, the indoor heat exchanger 7 and is configured to supply air for heat exchange with the refrigerant flowing through the indoor heat exchanger 7. The air-sending device 8*b* may be, for example, a sirocco fan.

(Controller 9)

The controller 9 includes a microcomputer and is configured to control, for example, a driving frequency of the compressor 1, a rotation speed (including ON/OFF) of each of the air-sending devices 8*a* and 8*b*, the energization of the solenoid valve coil 3*a* for switching the four-way valve 3, the opening degree of the expansion means 5, and opening and closing of the solenoid valve 6. The fan rotation speed of the air-sending device 8*b* disposed in the indoor unit 101 may be controlled by an indoor unit control device (not illustrated) that is disposed in the indoor unit 101 and is separate from the controller 9.

(Refrigerant Pipes)

The compressor outlet pipe 20 is a pipe connecting the discharge side of the compressor 1 and the check valve 2.

The gas pipe 21 is a pipe connecting the check valve 2 and the four-way valve 3.

The outdoor pipe 22 is a pipe connecting the four-way valve 3 and the first end of the outdoor heat exchanger 4.

The liquid pipe 23A is a pipe connecting the second end of the outdoor heat exchanger 4 and the expansion means 5.

The connecting pipe 23B is a pipe connecting the expansion means 5 and the solenoid valve 6.

The connecting pipe 24A is a pipe connecting the first end of the indoor heat exchanger 7 and the four-way valve 3.

The connecting pipe 24B is a pipe connecting the second end of the indoor heat exchanger 7 and the solenoid valve 6.

The compressor inlet pipe 25 is a pipe connecting the suction side of the compressor 1 and the four-way valve 3.

[Explanation for Four-Way Valve 3 and Flow of Refrigerant]

Figure 2:
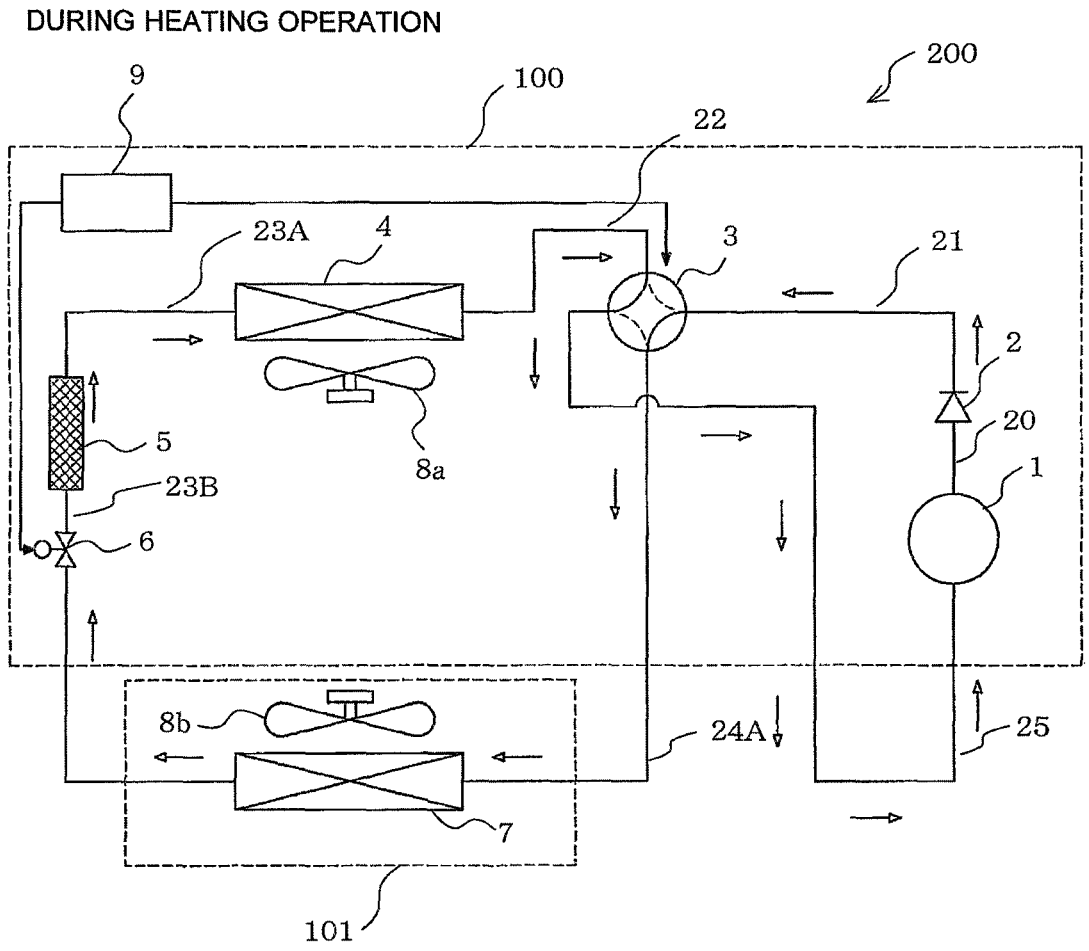
FIG. 2 is a diagram explaining the flow of a refrigerant during a heating operation of the air-conditioning apparatus illustrated in FIG. 1.

FIG. 2 is a diagram explaining the flow of the refrigerant during the heating operation of the air-conditioning apparatus 200 illustrated in FIG. 1. FIG. 3 is a diagram explaining the flow of the refrigerant in the four-way valve 3 illustrated in FIG. 2 during the heating operation. In FIG. 2, arrows indicate the flow direction of the refrigerant. In FIG. 3, arrows in the refrigerant passages A and B each indicate the flow direction of the refrigerant and arrows in the pipes 3*e* to 3*g* each indicate a pressure generated in the direction indicated by the arrow. An operation of the four-way valve 3 and the flow of the refrigerant in the refrigerant circuit of the air-conditioning apparatus 200 during the heating operation will be described with reference to FIGS. 2 and 3.

First, the operation of the four-way valve 3 will be described. When the heating operation is started, the controller 9 energizes the solenoid valve coil 3*a* of the four-way valve 3 to shift the needle valve 3*b* as illustrated in FIG. 3. The shifting of the needle valve 3*b* causes the pipe 3*e* to communicate with the pipe 3*g*, so that the piston 3*c* in the cylinder 3*d* is drawn to the right in the drawing sheet of FIG. 3 by the pressure of the refrigerant flowing through the refrigerant passage B. The four-way valve 3 is switched such that the refrigerant flows through the refrigerant passage A connecting the discharge side of the compressor 1 and the indoor heat exchanger 7 and the refrigerant flows through the refrigerant passage B connecting the suction side of the compressor 1 and the outdoor heat exchanger 4.

Next, the flow of the refrigerant in the refrigerant circuit of the air-conditioning apparatus 200 will be described. When the heating operation is started, the controller 9 energizes the solenoid valve 6 to open the valve.

The compressor 1 compresses a gas refrigerant flowing through the compressor inlet pipe 25 and discharges a high-temperature high-pressure gas refrigerant through the compressor outlet pipe 20. The discharged high-temperature high-pressure gas refrigerant passes through the compressor outlet pipe 20 and the check valve 2. The check valve 2 prevents the high-temperature high-pressure gas refrigerant from flowing backward to the compressor 1.

The high-temperature high-pressure gas refrigerant leaving the check valve 2 flows through the gas pipe 21, the refrigerant passage A in the four-way valve 3, and the connecting pipe 24A into the indoor heat exchanger 7. The air-sending device 8*b* acts to promote heat exchange between indoor air and the high-temperature high-pressure gas refrigerant which has flowed into the indoor heat exchanger 7, so that the refrigerant transfers heat to the indoor air and thus condenses. Specifically, the high-temperature high-pressure gas refrigerant condenses into a liquid refrigerant or a two-phase gas-liquid refrigerant in the indoor heat exchanger 7. In this case, the indoor air which has received heating energy from the high-temperature high-pressure gas refrigerant is supplied as heating air into an indoor space by the air-sending device 8*b*.

The liquid refrigerant or two-phase gas-liquid refrigerant after condensation in the indoor heat exchanger 7 flows through the solenoid valve 6 into the expansion means 5 where the pressure of the refrigerant is reduced. The pressure-reduced liquid refrigerant or two-phase gas-liquid refrigerant flows through the liquid pipe 23A into the outdoor heat exchanger 4.

The air-sending device 8*a* acts to promote heat exchange between outdoor air and the liquid refrigerant or two-phase gas-liquid refrigerant which has flowed into the outdoor heat exchanger 4, so that the refrigerant removes heat from the outdoor air and thus gasifies into a low-temperature low-pressure gas refrigerant.

The low-temperature low-pressure gas refrigerant flows out of the outdoor heat exchanger 4 and flows through the outdoor pipe 22, the refrigerant passage B in the four-way valve 3, and the compressor inlet pipe 25 to the suction side of the compressor 1. Subsequently, the above-described operation is repeated.

Figure 4:
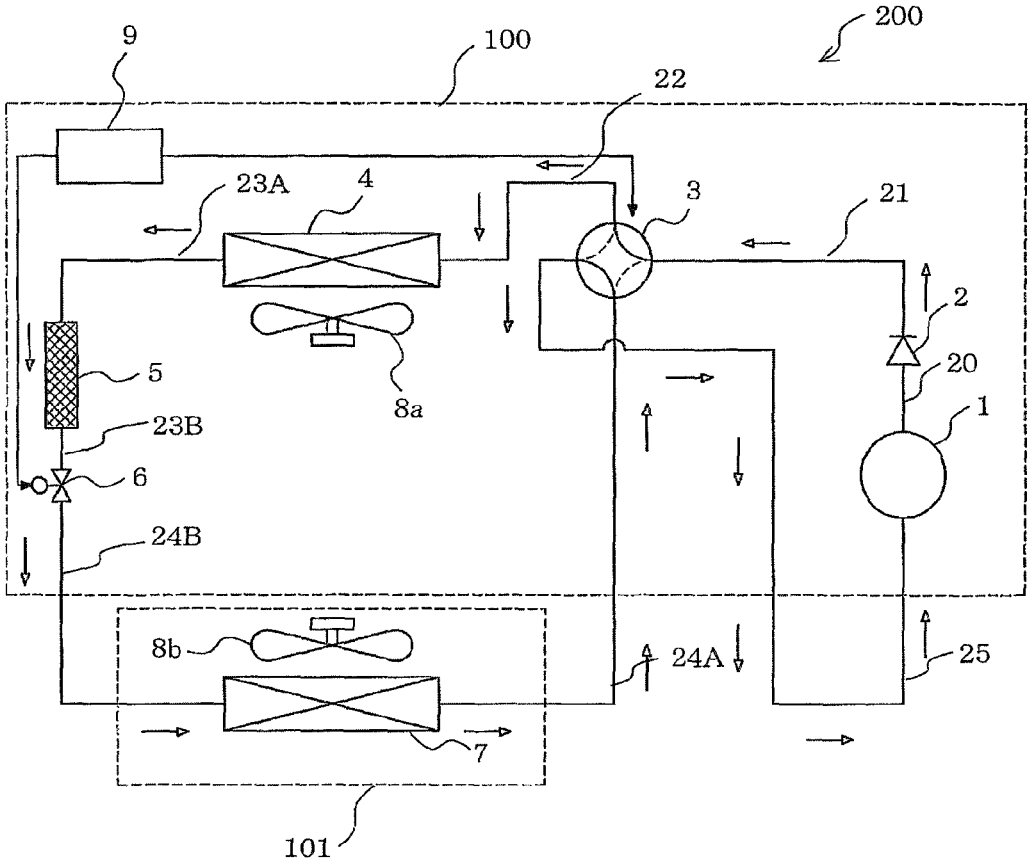
FIG. 4 is a diagram explaining the flow of the refrigerant during a cooling operation of the air-conditioning apparatus of FIG. 1.

FIG. 4 is a diagram explaining the flow of the refrigerant during the cooling operation of the air-conditioning apparatus 200 illustrated in FIG. 1. FIG. 5 is a diagram explaining the flow of the refrigerant in the four-way valve 3 illustrated in FIG. 4 during the cooling operation. In FIG. 4, arrows indicate the flow direction of the refrigerant. In FIG. 5, arrows in the refrigerant passages C and D each indicate the flow direction of the refrigerant and arrows in the pipes 3*e* to 3*g* each indicate a pressure generated in the direction indicated by the arrow. An operation of the four-way valve 3 and the flow of the refrigerant in the refrigerant circuit of the air-conditioning apparatus 200 during the cooling operation will be described with reference to FIGS. 4 and 5.

First, the operation of the four-way valve 3 will be described. When the cooling operation is started, the controller 9 shifts the needle valve 3*b* as illustrated in FIG. 5 without energizing the solenoid valve coil 3*a* of the four-way valve 3. The shifting of the needle valve 3*b* causes the pipe 3*f* to communicate with the pipe 3*g*, so that the piston 3*c* in the cylinder 3*d* is drawn to the left in the drawing sheet of FIG. 5 by the pressure of the refrigerant flowing through the refrigerant passage D. Consequently, the four-way valve 3 is switched such that the refrigerant flows through the refrigerant passage C connecting the discharge side of the compressor 1 and the outdoor heat exchanger 4 and the refrigerant flows through the refrigerant passage D connecting the suction side of the compressor 1 and the indoor heat exchanger 7.

Next, the flow of the refrigerant in the refrigerant circuit of the air-conditioning apparatus 200 will be described. When the cooling operation is started, the controller 9 energizes the solenoid valve 6 to open the valve.

The compressor 1 compresses a gas refrigerant flowing through the compressor inlet pipe 25 and discharges a high-temperature high-pressure gas refrigerant through the compressor outlet pipe 20. The discharged high-temperature high-pressure gas refrigerant passes through the compressor outlet pipe 20 and the check valve 2. The check valve 2 prevents the high-temperature high-pressure gas refrigerant from flowing backward to the compressor 1.

The high-temperature high-pressure gas refrigerant leaving the check valve 2 flows through the gas pipe 21, the refrigerant passage C in the four-way valve 3, and the outdoor pipe 22 into the outdoor heat exchanger 4. The air-sending device 8*a* acts to promote heat exchange between outdoor air and the high-temperature high-pressure gas refrigerant which has flowed into the outdoor heat exchanger 4, so that the refrigerant transfers heat to the outdoor air and thus condenses. Specifically, the high-temperature high-pressure gas refrigerant condenses into a liquid refrigerant or a two-phase gas-liquid refrigerant in the outdoor heat exchanger 4.

The liquid refrigerant or two-phase gas-liquid refrigerant after condensation in the outdoor heat exchanger 4 flows through the liquid pipe 23A into the expansion means 5 where the pressure of the refrigerant is reduced. The pressure-reduced liquid refrigerant or two-phase gas-liquid refrigerant flows through the connecting pipe 23B, the solenoid valve 6, and the connecting pipe 24B into the indoor heat exchanger 7.

The air-sending device 8*b* acts to promote heat exchange between indoor air and the liquid refrigerant or two-phase gas-liquid refrigerant which has flowed into the indoor heat exchanger 7, so that the refrigerant removes heat from the indoor air and thus gasifies into a low-temperature low-pressure gas refrigerant. In this case, the indoor air which has received cooling energy from the liquid refrigerant or two-phase gas-liquid refrigerant is supplied as cooling air into the indoor space by the air-sending device 8*b*.

The low-temperature low-pressure gas refrigerant flows out of the indoor heat exchanger 7 and flows through the connecting pipe 24A, the refrigerant passage D in the four-way valve 3, and the compressor inlet pipe 25 to the suction side of the compressor 1. Subsequently, the above-described operation is repeated.

[Explanation for Operation of Controller 9]

Figure 6:
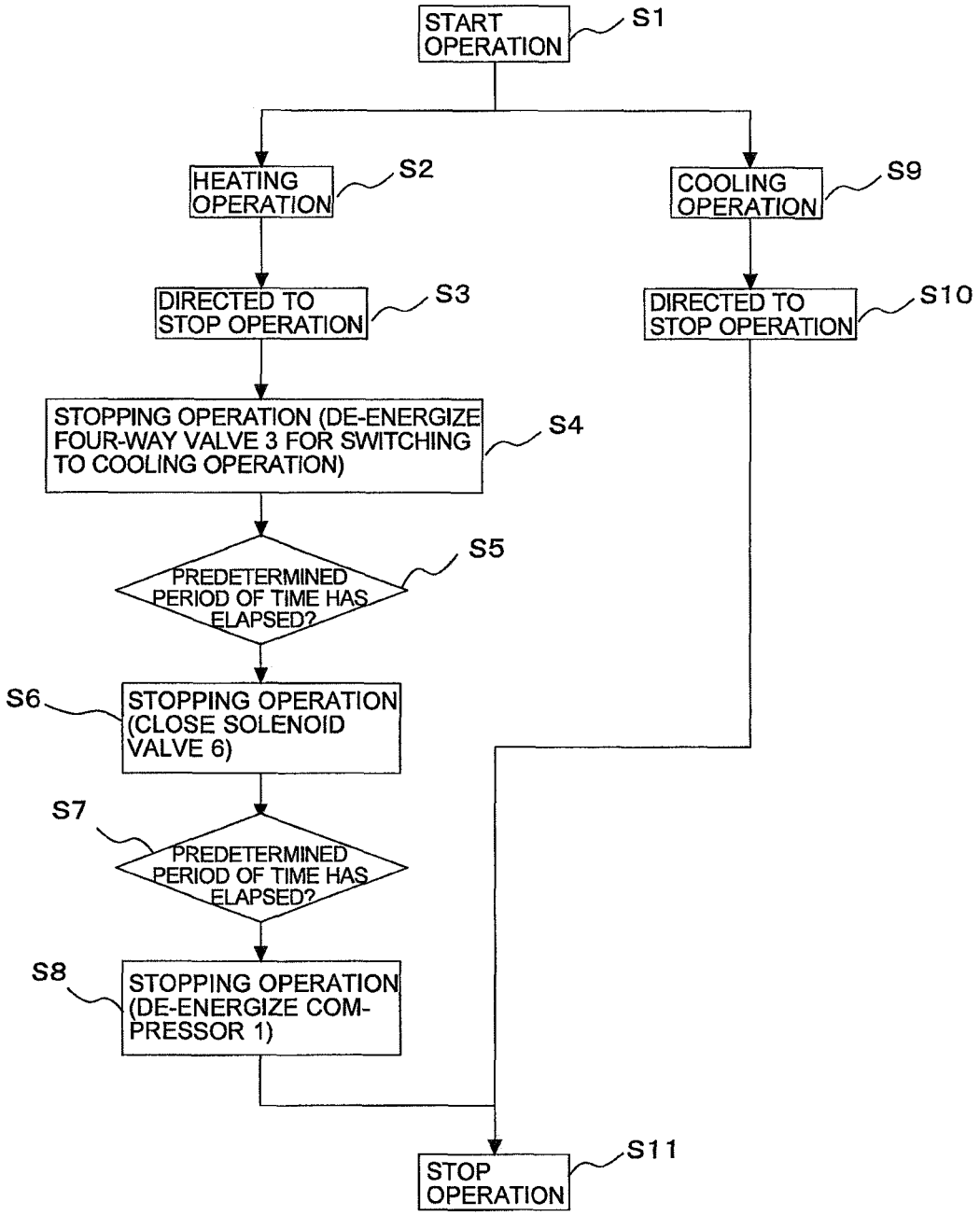
FIG. 6 is a diagram illustrating a flowchart of control for the air-conditioning apparatus according to Embodiment 1 of the present invention.

FIG. 6 is a diagram illustrating a flowchart of control for the air-conditioning apparatus 200 according to Embodiment 1. An operation of the controller 9 will be described with reference to FIG. 6.

(Step S1)

When receiving a setting instruction to start an operation from, for example, a remote control, the controller 9 starts an operation of the air-conditioning apparatus 200.

When the heating operation is set, the controller 9 proceeds to step S2.

When the cooling operation is set, the controller 9 proceeds to step S9.

(Step S2)

To perform the heating operation, the controller 9 controls the driving frequency of the compressor 1, the rotation speed of each of the air-sending devices 8*a* and 8*b*, and the opening degree of the expansion means 5, energizes the solenoid valve coil 3*a* of the four-way valve 3, and opens the solenoid valve 6.

(Step S3)

When receiving a setting instruction to stop the operation from, for example, the remote control, the controller 9 performs a refrigerant stagnation suppression control in the following steps S4 to S8.

(Step S4)

The controller 9 stops energizing the solenoid valve coil 3*a* of the four-way valve 3.

The processing in step S4 allows switching from the heating operation to the cooling operation.

(Step S5)

The controller 9 determines whether a predetermined period of time (e.g., five minutes) has elapsed.

When determining that the predetermined period of time has elapsed, the controller 9 proceeds to step S6.

When determining that the predetermined period of time has not elapsed, the controller 9 repeats step S5.

(Step S6)

The controller 9 fully closes the solenoid valve 6.

(Step S7)

The controller 9 determines whether a predetermined period of time (e.g., five minutes) has elapsed.

When determining that the predetermined period of time has elapsed, the controller 9 proceeds to step S8.

When determining that the predetermined period of time has not elapsed, the controller 9 repeats step S7.

(Step S8)

The controller 9 stops the compressor 1.

The processing in steps S4 to S8 allows the refrigerant to be stored in the refrigerant pipes arranged between the solenoid valve 6 and the check valve 2. More specifically, according to the processing in steps S4 to S8, the compressor 1 forces the refrigerant in the connecting pipe 24B, the indoor heat exchanger 7, the connecting pipe 24A, the refrigerant passage B in the four-way valve 3, and the compressor inlet pipe 25 to the discharge side of the compressor 1. The forced refrigerant is stored in a range including the check valve 2, the gas pipe 21, the refrigerant passage A in the four-way valve 3, the outdoor pipe 22, the outdoor heat exchanger 4, the liquid pipe 23A, the expansion means 5, the connecting pipe 23B, and the solenoid valve 6.

(Step S9)

To perform the cooling operation, the controller 9 controls the driving frequency of the compressor 1, the rotation speed of each of the air-sending devices 8*a* and 8*b*, and the opening degree of the expansion means 5 and opens the solenoid valve 6 without energizing the solenoid valve coil 3*a* of the four-way valve 3.

(Step S10)

When receiving a setting instruction to stop the operation from, for example, the remote control, the controller 9 proceeds to step S11. Specifically, the refrigerant stagnation suppression control is not performed during the cooling operation to prevent an increase in time that elapses before the operation of the air-conditioning apparatus 200 is stopped.

(Step S11)

The controller 9 stops the operation of the air-conditioning apparatus 200.

[Advantages of Air-Conditioning Apparatus 200 According to Embodiment 1]

When the heating operation is stopped, the air-conditioning apparatus 200 according to Embodiment 1 can perform the refrigerant stagnation suppression control of stopping energizing the solenoid valve coil 3*a* of the four-way valve 3 to switch from the heating operation to the cooling operation and then stopping the operation of the compressor 1.

Consequently, the refrigerant can be stored in the range including the check valve 2 on the discharge side, the gas pipe 21, the refrigerant passage A in the four-way valve 3, the outdoor pipe 22, the outdoor heat exchanger 4, the liquid pipe 23A, the expansion means 5, the connecting pipe 23B, and the solenoid valve 6. The refrigerant can be separated from the lubricating oil in the compressor 1 and dissolution of the refrigerant in the lubricating oil can be suppressed. Thus, the air-conditioning apparatus 200 according to Embodiment 1 can reduce poor lubrication in the compressor 1.

The air-conditioning apparatus 200 according to Embodiment 1 performs the control of stopping energizing the solenoid valve coil 3*a* of the four-way valve 3 for switching to the cooling operation and then stopping the operation of the compressor The apparatus can suppress the stagnation of the refrigerant while suppressing complication of the control.

The air-conditioning apparatus 200 according to Embodiment 1 can perform the refrigerant stagnation suppression control without using outdoor air temperature detecting means or the like. The apparatus can suppress the stagnation of the refrigerant while accordingly suppressing an increase in the number of components.

When the heating operation is stopped, the air-conditioning apparatus 200 according to Embodiment 1 can suppress the stagnation of the refrigerant by stopping energizing the solenoid valve coil 3*a* of the four-way valve 3 for switching to the cooling operation and then stopping the operation of the compressor 1. Consequently, if the apparatus does not include a heater or the like, the apparatus can suppress the stagnation of the refrigerant and can accordingly reduce power consumption.

Embodiment 2

Figure 7:
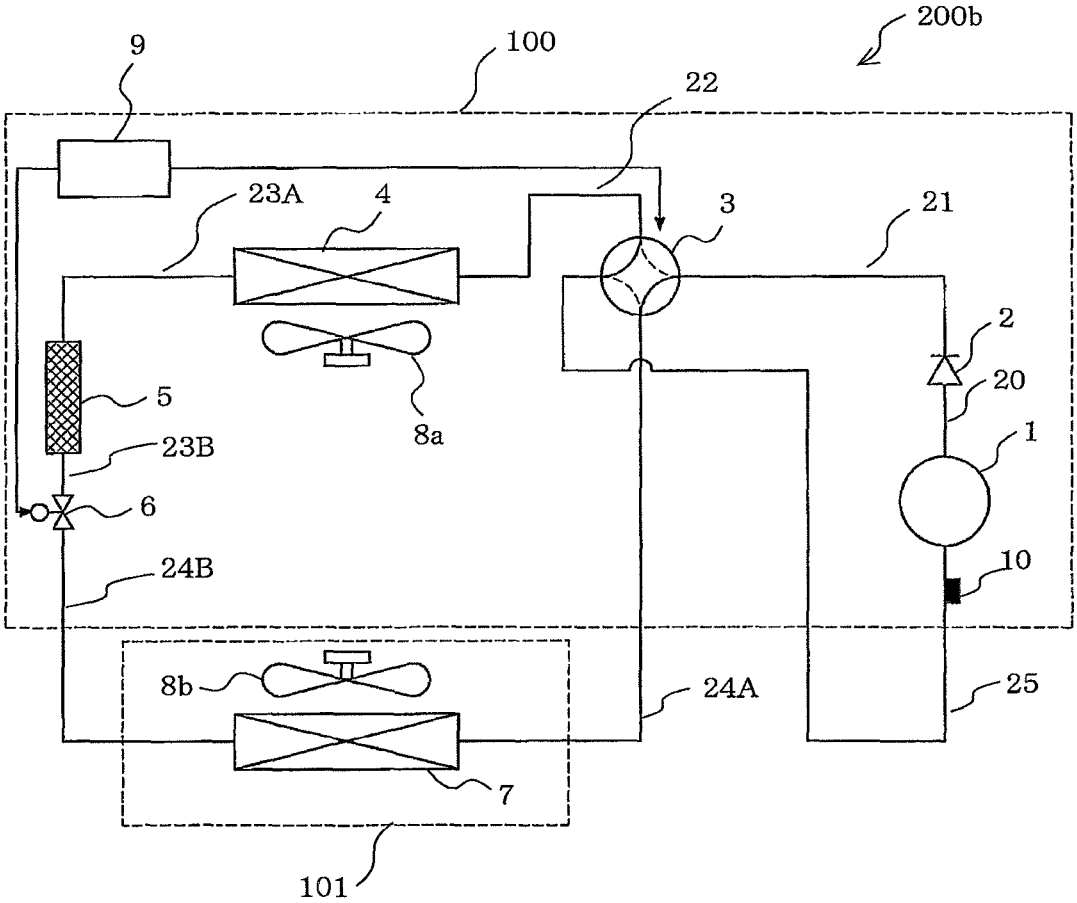
FIG. 7 illustrates an exemplary configuration of a refrigerant circuit of an air-conditioning apparatus according to Embodiment 2 of the present invention.

In Embodiment 2, the same components as those in Embodiment 1 are designated by the same reference numerals and the difference between Embodiments 1 and 2 will be mainly described. FIG. 7 illustrates an exemplary configuration of a refrigerant circuit of an air-conditioning apparatus 200*b* according to Embodiment 2.

The air-conditioning apparatus 200*b* according to Embodiment 2 includes low pressure detecting means 10 in addition to the components of the air-conditioning apparatus 200 according to Embodiment 1. The low pressure detecting means 10 for detecting a pressure is disposed in the compressor inlet pipe 25 connected to the suction side of the compressor 1. The low pressure detecting means 10 may be, for example, a pressure sensor. The other components in Embodiment 2 are the same as those in Embodiment 1.

Figure 8:
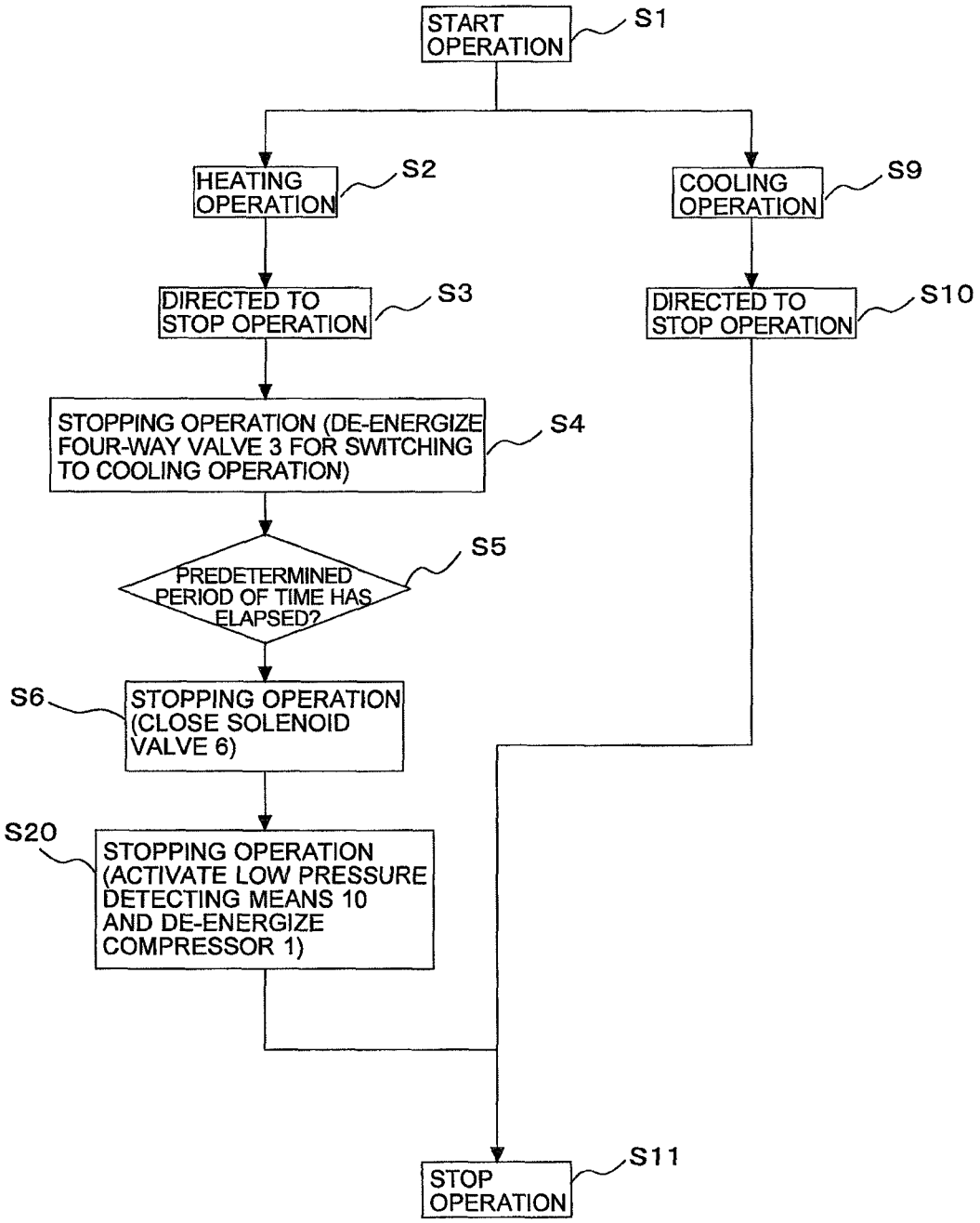
FIG. 8 is a diagram illustrating a flowchart of control for the air-conditioning apparatus according to Embodiment 2 of the present invention.

FIG. 8 is a diagram illustrating a flowchart of control for the air-conditioning apparatus 200*b* according to Embodiment 2. An operation of the controller 9 will be described with reference to FIG. 8. The control flowchart of FIG. 8 includes step S20 that replaces steps S7 and S8 in the flowchart of FIG. 6. Since the other steps in FIG. 8 are the same as those in FIG. 6, a description of the same control processing is omitted.

(Step S20)

The controller 9 determines whether a pressure detected by the low pressure detecting means 10 is at or below a given pressure.

When determining that the detected pressure is at or below the given pressure, the controller 9 stops the compressor 1.

When determining that the detected pressure is not at or below the given pressure, the controller 9 continues the operation of the compressor 1.

[Advantages of Air-Conditioning Apparatus According to Embodiment 2]

The air-conditioning apparatus 200*b* according to Embodiment 2 offers the following advantage in addition to the advantages offered by the air-conditioning apparatus 200 according to Embodiment 1. Since the air-conditioning apparatus 200*b* according to Embodiment 2 stops the compressor 1 on the basis of a pressure detected by the low pressure detecting means 10, the stagnation of the refrigerant can be more reliably suppressed.

Embodiment 3

Figure 9:
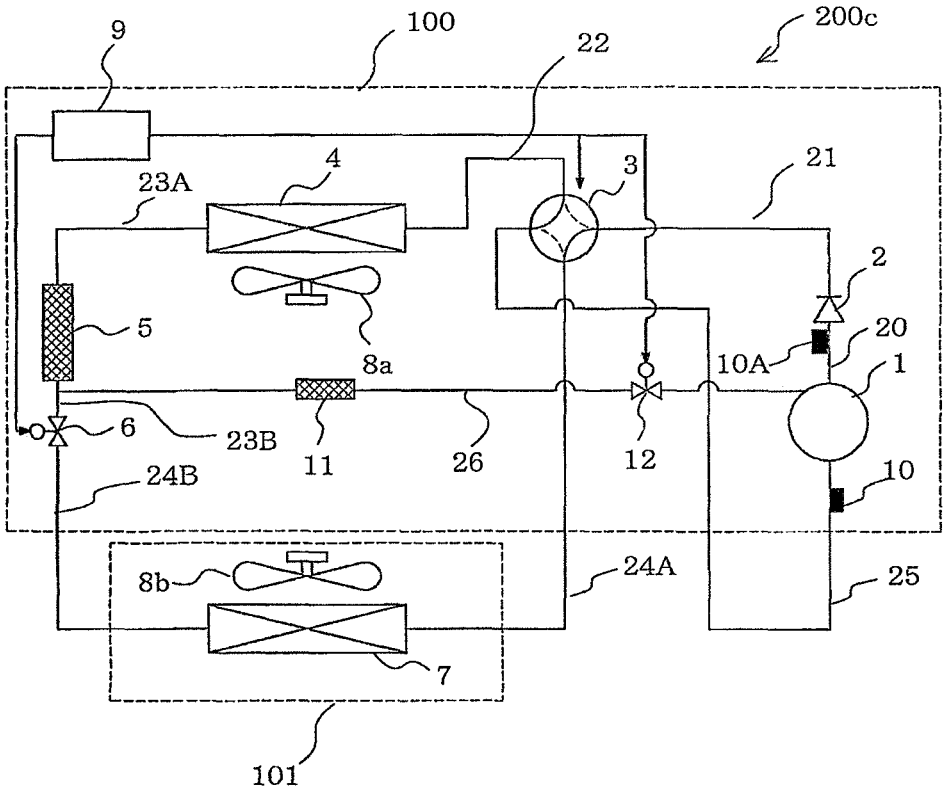
FIG. 9 illustrates an exemplary configuration of a refrigerant circuit of an air-conditioning apparatus according to Embodiment 3 of the present invention.

In Embodiment 3, the same components as those in Embodiments 1 and 2 are designated by the same reference numerals and the difference from Embodiments 1 and 2 will be mainly described. FIG. 9 illustrates an exemplary configuration of a refrigerant circuit in an air-conditioning apparatus 200*c* according to Embodiment 3. The air-conditioning apparatus 200*c* according to Embodiment 3 includes the same components as those of the air-conditioning apparatus 200*b* according to Embodiment 2 and further includes a refrigerant pipe 26 that connects the connecting pipe 23B and the compressor 1, expansion means 11 for reducing the pressure of the refrigerant flowing through the refrigerant pipe 26, a solenoid valve 12 that switches between passing and non-passing of the refrigerant through the refrigerant pipe 26, and temperature detecting means 10A for detecting the temperature of the refrigerant flowing through the compressor outlet pipe 20.

The refrigerant pipe 26 is a pipe that connects the connecting pipe 23B and the compressor 1. More specifically, the refrigerant pipe 26 is a pipe connecting the connecting pipe 23B and a fixed scroll (not illustrated) in the compressor 1. The expansion means 11 and the solenoid valve 12 are arranged in the refrigerant pipe 26.

The expansion means 11 is configured to reduce the pressure of the refrigerant flowing through the refrigerant pipe 26 such that the refrigerant is expanded. The expansion means 11 is connected at a first end to the connecting pipe 23B and is connected at a second end to the solenoid valve 12. Like the expansion means 5, the expansion means 11 may be a component having a variably controllable opening degree, for example, an electronic expansion valve.

The solenoid valve 12 is a valve whose opening and closing are controlled by the controller 9 and which is capable of switching between passing and non-passing of the refrigerant through the valve. The solenoid valve 12 is connected at a first end to the expansion means 11 and is connected at a second end to the fixed scroll in the compressor 1.

The temperature detecting means 10A is configured to detect the temperature of the refrigerant flowing through the compressor outlet pipe 20 connecting the discharge side of the compressor 1 and the check valve 2. The temperature detecting means 10A is connected to the controller 9. The temperature detecting means 10A may be, for example, a thermistor.

Figure 10:
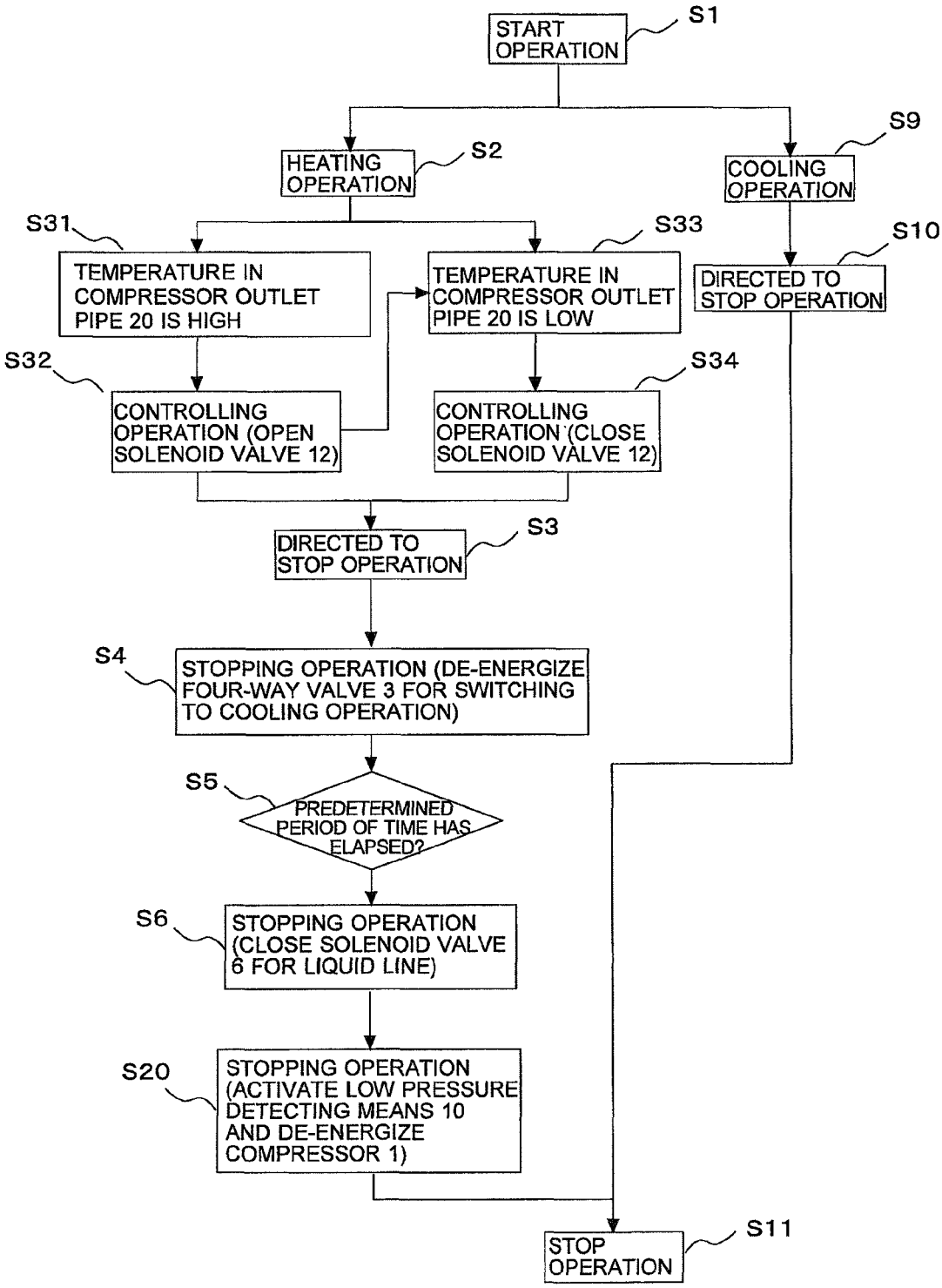
FIG. 10 is a diagram illustrating a flowchart of control for the air-conditioning apparatus according to Embodiment 3 of the present invention.

FIG. 10 is a diagram illustrating a flowchart of control for the air-conditioning apparatus 200*c* according to Embodiment 3. An operation of the controller 9 will be described with reference to FIG. 10.

The control flowchart of FIG. 10 includes steps S31 to S34 which are added between steps S2 and S3 in the flowchart of FIG. 8. Since the other steps in FIG. 10 are the same as those in FIG. 8, a description of the same control processing is omitted.

(Step S2)

To perform the heating operation, the controller 9 controls the driving frequency of the compressor 1, the rotation speed of each of the air-sending devices 8*a* and 8*b*, and the opening degree of the expansion means 5, energizes the solenoid valve coil 3*a* of the four-way valve 3, and opens the solenoid valve 6.

Furthermore, the controller 9 determines whether a temperature detected by the temperature detecting means 10A is at or above a given temperature.

When determining that the temperature detected by the temperature detecting means 10A is at or above the given temperature, the controller 9 proceeds to step S31.

When determining that the temperature detected by the temperature detecting means 10A is below the given temperature, the controller 9 proceeds to step S33.

(Step S31)

Since the temperature detected by the temperature detecting means 10A is at or above the given temperature, the controller 9 proceeds to step S32.

(Step S32)

The controller 9 opens the solenoid valve 12.

Upon opening the solenoid valve 12, the controller 9 determines whether a temperature detected by the temperature detecting means 10A is at or above the given temperature.

When determining that the temperature detected by the temperature detecting means 10A is at or above the given temperature, the controller 9 proceeds to step S3.

When determining that the temperature detected by the temperature detecting means 10A is below the given temperature, the controller 9 proceeds to step S33.

(Step S33)

Since the temperature detected by the temperature detecting means 10A is below the given temperature, the controller 9 proceeds to step S34.

(Step S34)

The controller 9 closes the solenoid valve 12.

[Advantages of Air-Conditioning Apparatus According to Embodiment 3]

The air-conditioning apparatus 200*c* according to Embodiment 3 offers the following advantages in addition to the advantages offered by the air-conditioning apparatuses according to Embodiments 1 and 2. Specifically, the air-conditioning apparatus 200*c* according to Embodiment 3 controls opening and closing of the solenoid valve 12 so that the liquid refrigerant or two-phase gas-liquid refrigerant leaving the solenoid valve 6 flows through the refrigerant pipe 26 into the fixed scroll in the compressor 1 during the heating operation. This allows the circulation amount of refrigerant flowing into the compressor 1 to be increased, thus increasing heating capacity.

In the air-conditioning apparatus 200*c* according to Embodiment 3, the temperature of the high-temperature high-pressure gas refrigerant obtained by compression through the compressor 1 is reduced by the liquid refrigerant or two-phase gas-liquid refrigerant leaving the indoor heat exchanger 7. Thus, the temperature of the refrigerant discharged from the compressor 1 during the heating operation can be reduced, so that the compressor 1 can be stably operated.

Embodiment 4

Figure 11:
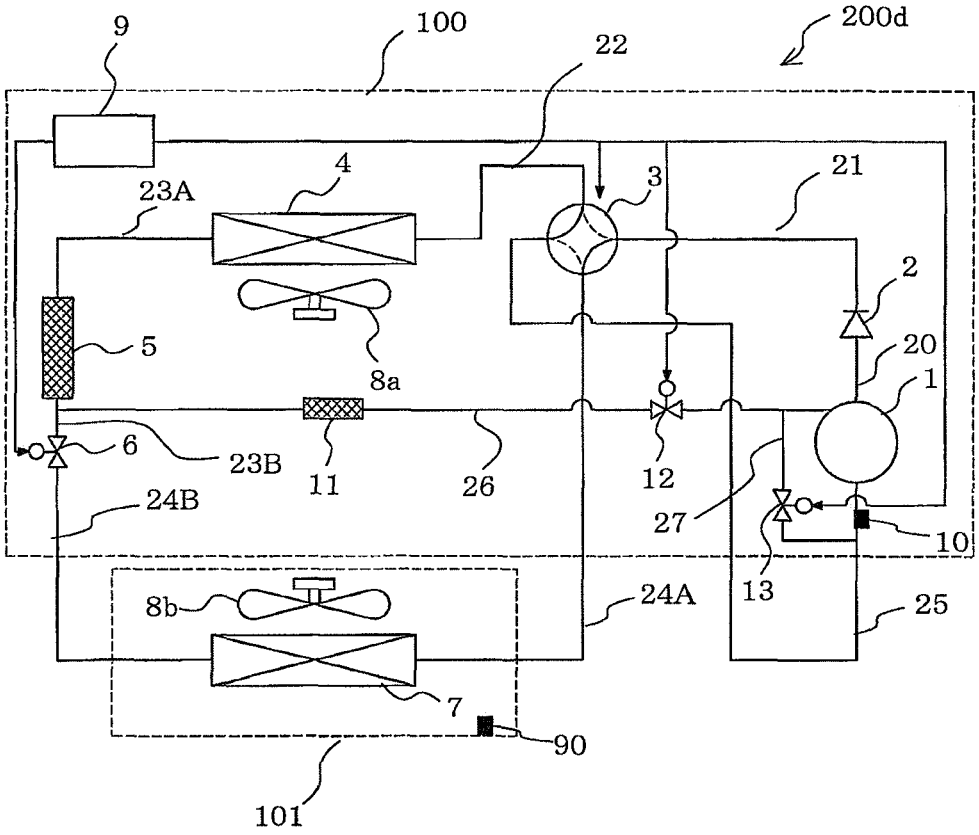
FIG. 11 illustrates an exemplary configuration of a refrigerant circuit of an air-conditioning apparatus according to Embodiment 4 of the present invention.

In Embodiment 4, the same components as those in Embodiments 1 to 3 are designated by the same reference numerals and the difference from Embodiments 1 to 4 will be mainly described. FIG. 11 illustrates an exemplary configuration of a refrigerant circuit of an air-conditioning apparatus 200*d* according to Embodiment 4. The air-conditioning apparatus 200*d* according to Embodiment 4 includes the same components as those of the air-conditioning apparatus 200*c* according to Embodiment 3 and further includes a gas pipe 27 that connects the refrigerant pipe 26 and the compressor inlet pipe 25, a solenoid valve 13 disposed in the gas pipe 27, and temperature detecting means 90 for detecting the temperature of an air-conditioning target space. In the following description, it is assumed that the air-conditioning target space is an indoor space.

The gas pipe 27 is a pipe that connects the compressor inlet pipe 25 and a point of the refrigerant pipe 26 between the solenoid valve 12 and the compressor 1. The solenoid valve 13 is disposed in the gas pipe 27.

The solenoid valve 13 is a valve whose opening and closing are controlled by the controller 9 and which is capable of switching between passing and non-passing of the refrigerant through the valve. The solenoid valve 13 is connected at a first end to the gas pipe 27 adjacent to the refrigerant pipe 26 and is connected at a second end to the gas pipe 27 adjacent to the compressor inlet pipe 25.

The temperature detecting means 90 is configured to detect the temperature of the air-conditioning target space (e.g., an indoor space). The temperature detecting means 90 is connected to the controller 9. The temperature detecting means 90 may be, for example, a thermistor.

Figure 12:
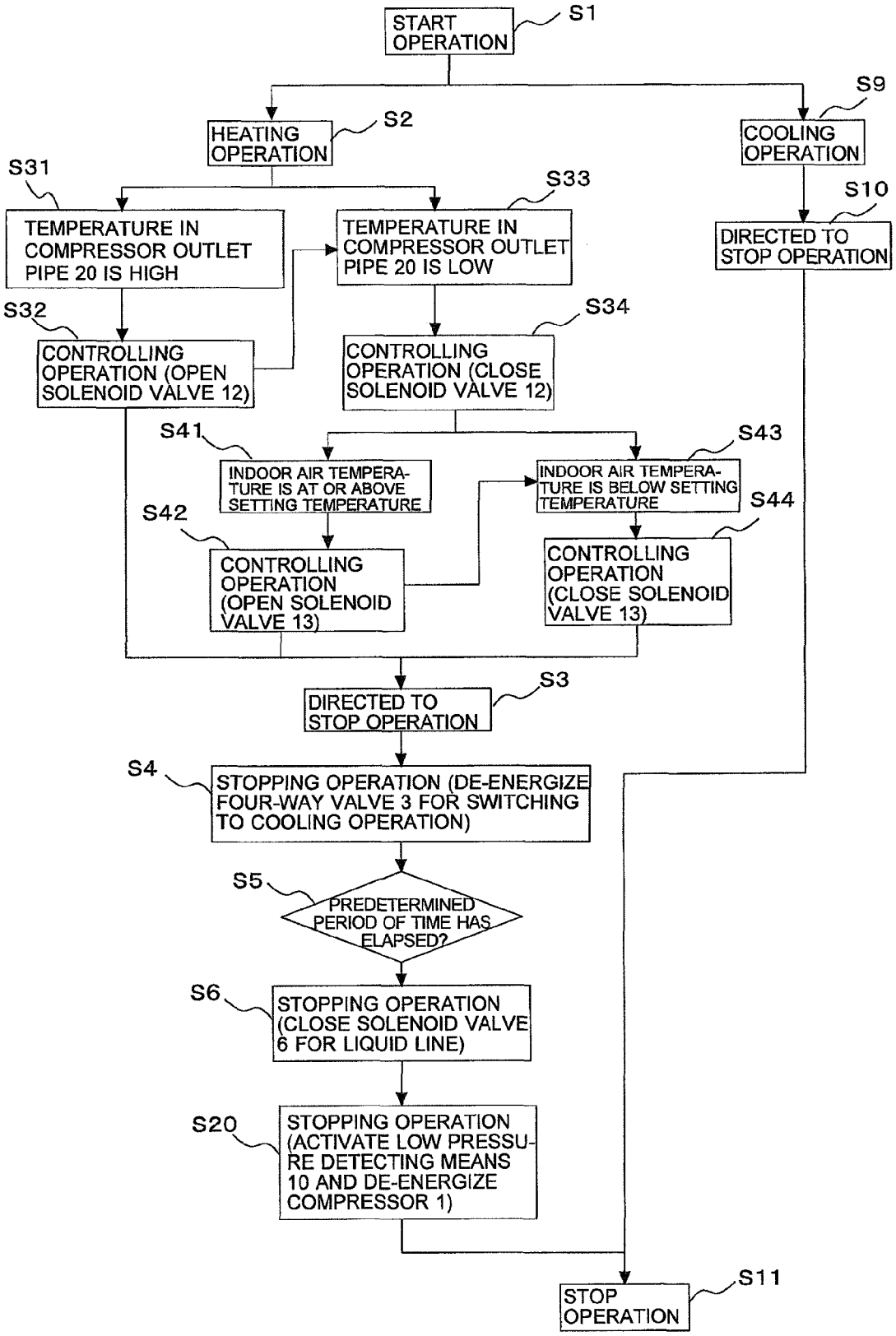
FIG. 12 is a diagram illustrating a flowchart of control for the air-conditioning apparatus according to Embodiment 4 of the present invention.

FIG. 12 is a diagram illustrating a flowchart of control for the air-conditioning apparatus 200*d* according to Embodiment 4. An operation of the controller 9 will be described with reference to FIG. 12.

The control flowchart of FIG. 12 includes steps S41 to S44 which are added between steps S34 and S3 in the flowchart of FIG. 10. Since the other steps in FIG. 12 are the same as those in FIG. 10, a description of the same control processing is omitted.

(Step S34)

The controller 9 closes the solenoid valve 12.

Upon closing the solenoid valve 12, the controller 9 determines whether a detected indoor air temperature is at or above a given temperature.

When determining that the detected indoor air temperature is at or above the given temperature, the controller 9 proceeds to step S41.

When determining that the detected indoor air temperature is below the given temperature, the controller 9 proceeds to step S43.

(Step S41)

Since the detected indoor air temperature is at or above the given temperature, the controller 9 proceeds to step S42.

(Step S42)

The controller 9 opens the solenoid valve 13.

Upon opening the solenoid valve 13, the controller 9 determines whether a detected indoor air temperature is at or above the given temperature.

When determining that the detected indoor air temperature is at or above the given temperature, the controller 9 proceeds to step S3.

When determining that the detected indoor air temperature is below the given temperature, the controller 9 proceeds to step S43 and then proceeds to S44.

(Step S43, Step S44)

The controller 9 closes the solenoid valve 13. After that, the controller 9 proceeds to step S3.

According to Embodiment 4, when the indoor air temperature is below a setting temperature during the heating operation, the controller 9 stops energizing the solenoid valve 12 and the solenoid valve 13 to close these valves, so that the high-temperature high-pressure gas refrigerant compressed in the compressor 1 is discharged through the compressor outlet pipe 20.

Furthermore, when the indoor air temperature reaches the setting temperature during the heating operation, the controller 9 continues to stop energizing the solenoid valve 12 such that the solenoid valve 12 is kept closed and energizes the solenoid valve 13 to open the valve. This enables an intermediate-temperature intermediate-pressure gas refrigerant compressed in the compressor 1 to escape from the compressor 1 through the refrigerant pipe 26, the gas pipe 27, and the compressor inlet pipe 25.

[Advantages of Air-Conditioning Apparatus According to Embodiment 4]

The air-conditioning apparatus 200*d* according to Embodiment 4 offers the following advantages in addition to the advantages offered by the air-conditioning apparatuses according to Embodiments 1 to 3. The air-conditioning apparatus 200*d* according to Embodiment 4 can control the amount of gas refrigerant to be supplied to the compressor 1 on the basis of an indoor air temperature. In other words, since the air-conditioning apparatus 200*d* according to Embodiment 4 can control the amount of gas refrigerant to be compressed in the compressor 1 on the basis of the indoor air temperature, the apparatus can control the capacity of the compressor 1 without stopping the operation of the compressor 1, thus reducing power consumption.

Since the air-conditioning apparatus 200*d* according to Embodiment 4 can control the capacity of the compressor 1 without stopping the operation of the compressor 1, the frequency of activating and stopping the compressor 1 can accordingly be reduced. Thus, a load applied to a bearing included in the compressor 1 when the compressor 1 is activated can be reduced. In other words, the air-conditioning apparatus 200*d* according to Embodiment 4 includes the compressor 1 that is highly reliable.

Embodiment 5

Figure 13:
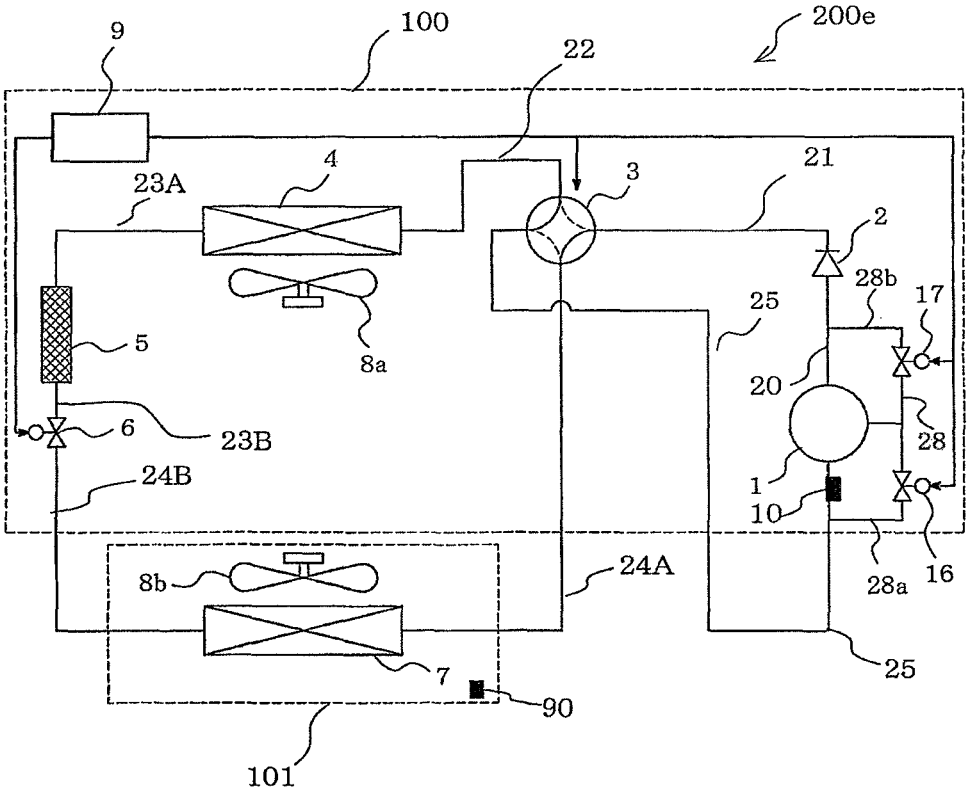
FIG. 13 illustrates an exemplary configuration of a refrigerant circuit of an air-conditioning apparatus according to Embodiment 5 of the present invention.
Figure 14A:
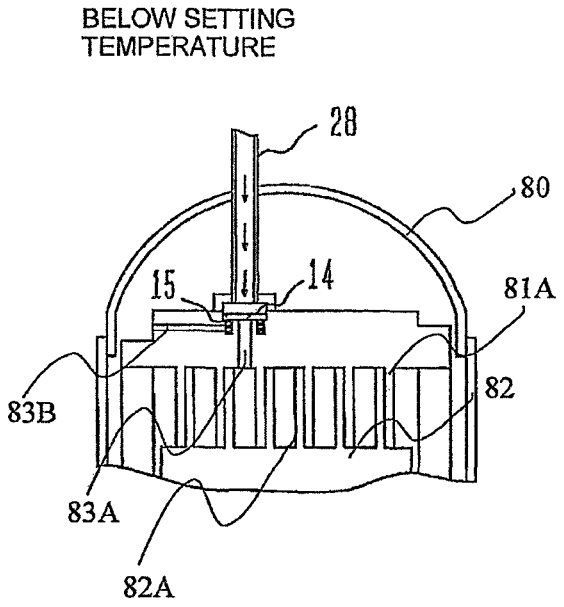
FIG. 14A includes a diagram explaining the flow of the refrigerant in a compressor of the air-conditioning apparatus according to Embodiment 5 of the present invention, in which the indoor temperature is below the setting temperature.
Figure 14B:
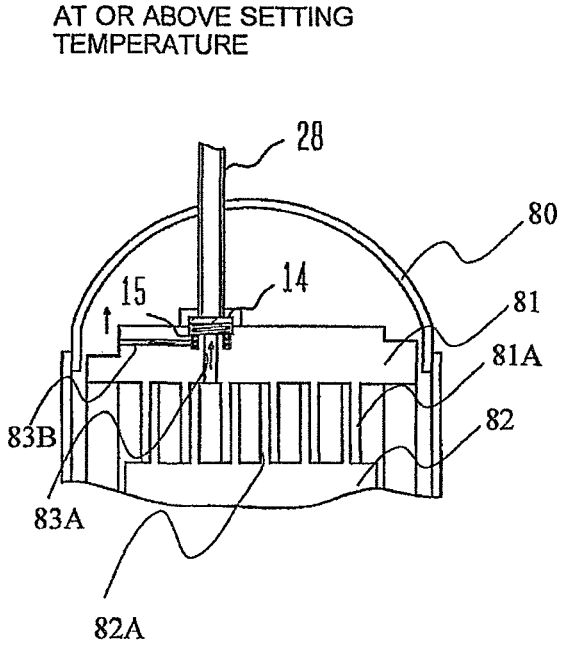
FIG. 14B includes a diagram explaining the flow of the refrigerant in a compressor of the air-conditioning apparatus according to Embodiment 5 of the present invention, in which the indoor temperature is equal to or above the setting temperature.

In Embodiment 5, the same components as those in Embodiments 1 to 4 are designated by the same reference numerals and the difference from Embodiments 1 to 4 will be mainly described. FIG. 13 illustrates an exemplary configuration of a refrigerant circuit of an air-conditioning apparatus 200*e* according to Embodiment 5. FIGS. 14A and 14B include diagrams explaining the flow of the refrigerant in the compressor 1 of the air-conditioning apparatus 200*e* according to Embodiment 5. FIG. 14A illustrates the flow of the refrigerant in the compressor 1 at an indoor air temperature lower than a setting temperature and FIG. 14B illustrates the flow of the refrigerant in the compressor 1 at an indoor air temperature higher than or equal to the setting temperature.

The air-conditioning apparatus 200*e* according to Embodiment 5 includes the same components as those of the air-conditioning apparatus 200*b* according to Embodiment 2 and further includes a gas pipe 28*a* connected to the compressor inlet pipe 25, a gas pipe 28*b* connected to the compressor outlet pipe 20, a solenoid valve 16 connected at a first end to the gas pipe 28*a*, a solenoid valve 17 connected at a first end to the gas pipe 28*b*, and a gas pipe 28 connected to a second end of the solenoid valve 16, a second end of the solenoid valve 17, and the compressor 1. In addition, the air-conditioning apparatus 200*e* according to Embodiment 5 includes a spring 15 and a valve 14 for providing a gas seal in the compressor 1.

The compressor 1 includes a sealed container 80 that serves as an outer casing of the compressor 1. The sealed container 80 accommodates at least, for example, a fixed scroll 81 having a fixed scroll lap 81A for compressing a fluid and an orbiting scroll 82 having an orbiting scroll lap 82A for compressing the fluid.

The fixed scroll 81 is configured to compress the fluid together with the orbiting scroll 82. The fixed scroll 81 is disposed so as to face the orbiting scroll 82. An upper surface of the fixed scroll 81 is connected to the gas pipe 28.

The fixed scroll 81 includes a refrigerant discharge passage 83A through which the refrigerant compressed by the fixed scroll 81 and the orbiting scroll 82 is discharged. The refrigerant discharge passage 83A extends vertically. The fixed scroll 81 further includes a refrigerant discharge passage 83B that communicates between the refrigerant discharge passage 83A and the sealed container 80. The refrigerant discharge passage 83B extends horizontally.

The gas pipe 28*a* is connected at a first end to the compressor inlet pipe 25 and is connected at a second end to the solenoid valve 16.

The gas pipe 28*b* is connected at a first end to the compressor outlet pipe 20 and is connected at a second end to the solenoid valve 17.

The gas pipe 28 is connected to the second end of the solenoid valve 16, the second end of the solenoid valve 17, and the fixed scroll 81 of the compressor 1.

Each of the solenoid valves 16 and 17 is a valve whose opening and closing are controlled by the controller 9 and which is capable of switching between passing and non-passing of the refrigerant through the valve. The solenoid valve 16 is connected at the first end to the gas pipe 28*a* and is connected at the second end to the gas pipe 28. The solenoid valve 17 is connected at the first end to the gas pipe 28*b* and is connected at the second end to the gas pipe 28.

When the refrigerant is supplied through the gas pipe 28, the valve 14 is pressed together with the spring 15 against the fixed scroll 81 to block (seal) the communication between the refrigerant discharge passages 83A and 83B. While the refrigerant is not supplied through the gas pipe 28, the refrigerant supplied through the refrigerant discharge passage 83A causes the spring 15 to extend upward and presses the valve 14 upward, thus allowing the refrigerant discharge passage 83A to communicate with the refrigerant discharge passage 83B.

The spring 15 is disposed in upper part of the fixed scroll 81 so as to coincide with the refrigerant discharge passage 83A. The spring 15 is disposed so as to contract when the valve 14 is forced downward by the gas refrigerant supplied through the gas pipe 28. The contracting of the spring 15 blocks the communication between the refrigerant discharge passages 83A and 83B. Specifically, the spring 15 has a function of, upon contracting, preventing the refrigerant compressed by the fixed scroll 81 and the orbiting scroll 82 from flowing from the refrigerant discharge passage 83A to the refrigerant discharge passage 83B and has a function of, upon extending, permitting the refrigerant compressed by the fixed scroll 81 and the orbiting scroll 82 to flow from the refrigerant discharge passage 83A to the refrigerant discharge passage 83B. Although Embodiment 5 has been described with respect to an implementation using the spring 15, Embodiment 5 is not intended to be limited to this implementation. For example, a rubber-like member may be substituted for the spring 15.

Figure 15:
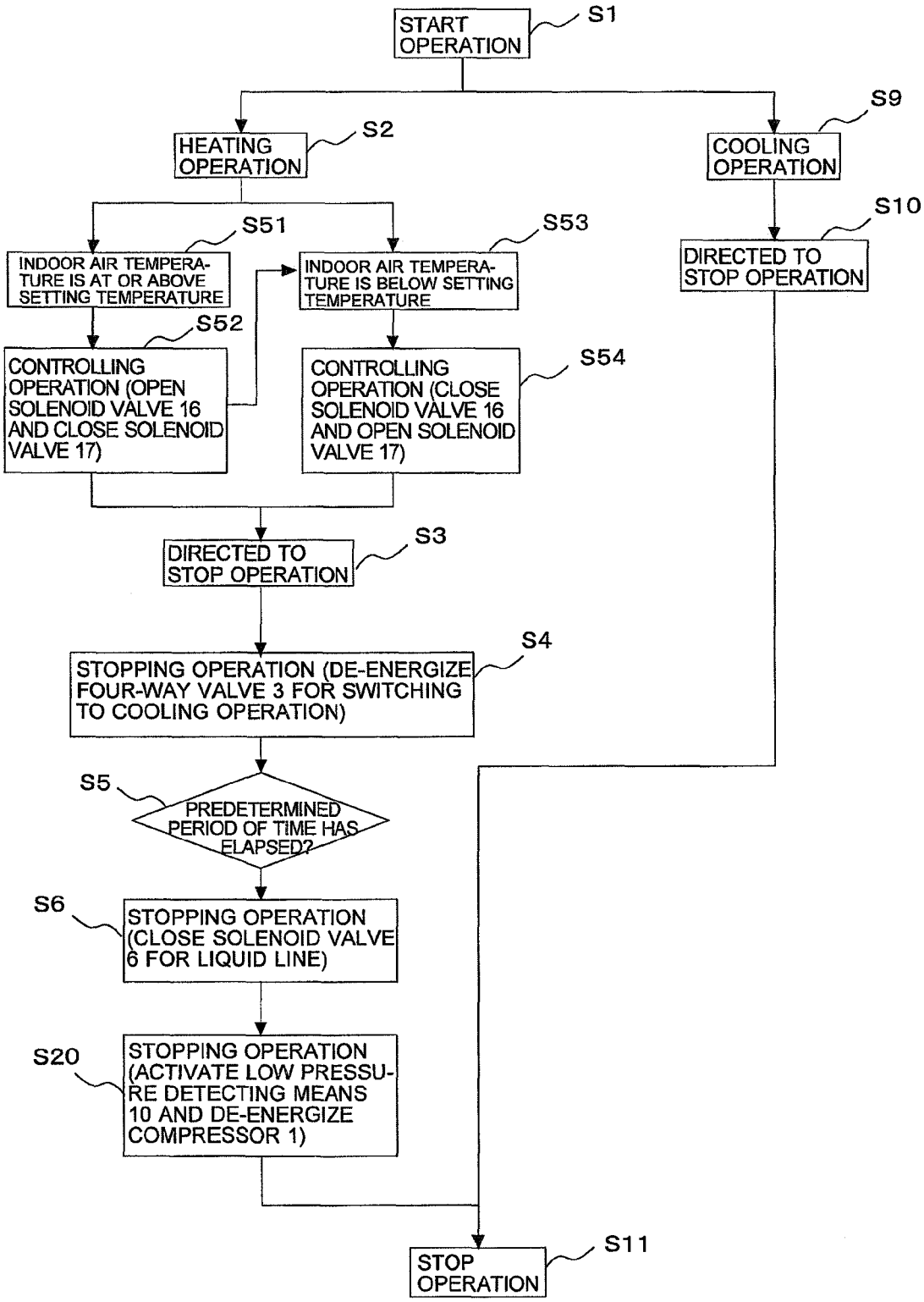
FIG. 15 is a diagram illustrating a flowchart of control for the air-conditioning apparatus according to Embodiment 5 of the present invention.

FIG. 15 is a diagram illustrating a flowchart of control for the air-conditioning apparatus 200*e* according to Embodiment 5. An operation of the controller 9 will be described with reference to FIG. 15.

The control flowchart of FIG. 15 includes steps S51 to S54 which are added between steps S2 and S3 in the flowchart of FIG. 8. Since the other steps in FIG. 15 are the same as those in FIG. 8, a description of the same control processing is omitted.

(Step S2)

To perform the heating operation, the controller 9 controls the driving frequency of the compressor 1, the rotation speed of each of the air-sending devices 8*a* and 8*b*, and the opening degree of the expansion means 5, energizes the solenoid valve coil 3*a* of the four-way valve 3, and opens the solenoid valve 6.

After that, the controller 9 determines whether a detected indoor air temperature is at or above a given temperature.

When determining that the detected indoor air temperature is at or above the given temperature, the controller 9 proceeds to step S51.

When determining that the detected indoor air temperature is below the given temperature, the controller 9 proceeds to step S53.

(Step S51)

Since the detected indoor air temperature is at or above the given temperature, the controller 9 proceeds to step S52.

(Step S52) The controller 9 opens the solenoid valve 16 and closes the solenoid valve 17.

Upon opening the solenoid valve 16 and closing the solenoid valve 17, the controller 9 determines whether a detected indoor air temperature is at or above the given temperature.

When determining that the detected indoor air temperature is at or above the given temperature, the controller 9 proceeds to step S3.

When determining that the detected indoor air temperature is below the given temperature, the controller 9 proceeds to step S53.

(Step S53) Since the detected indoor air temperature is below the given temperature, the controller 9 proceeds to step S54.

(Step S54)

The controller 9 closes the solenoid valve 16 and opens the solenoid valve 17.

The air-conditioning apparatus 200*e* according to Embodiment 5 can control the amount of gas refrigerant to be compressed in the compressor 1 depending on an indoor air temperature at or above the given temperature and an indoor air temperature below the given temperature.

More specifically, when the indoor air temperature is at or above the given temperature, the controller 9 opens the solenoid valve 16 and closes the solenoid valve 17. Consequently, an intermediate-temperature intermediate-pressure gas refrigerant compressed by the fixed scroll 81 and the orbiting scroll 82 of the compressor 1 upwardly presses the valve 14 and the spring 15 and flows through the refrigerant discharge passages 83A and 83B into the sealed container 80. In other words, since the indoor air temperature is at or above the given temperature, the controller 9 controls the amount of refrigerant so that an excess of refrigerant is not supplied to the compressor outlet pipe 20 (see FIG. 14B).

On the other hand, when the indoor air temperature is below the given temperature, the controller 9 closes the solenoid valve 16 and opens the solenoid valve 17. Consequently, the intermediate-temperature intermediate-pressure gas refrigerant compressed by the fixed scroll 81 and the orbiting scroll 82 of the compressor 1 flows through the compressor outlet pipe 20, so that part of the refrigerant flowing through the compressor outlet side pipe 20 flows through the gas pipe 28*b* into the compressor 1. The refrigerant which has flowed into the compressor 1 downwardly presses the valve 14 and the spring 15 to block the communication between the refrigerant discharge passages 83A and 83B. Specifically, since the indoor air temperature is below the given temperature, the controller 9 prevents the refrigerant compressed by the fixed scroll 81 and the orbiting scroll 82 from escaping through the refrigerant discharge passage 83B and controls the refrigerant such that the refrigerant is reliably discharged through the compressor outlet pipe 20 (see FIG. 14A).

[Advantages of Air-Conditioning Apparatus According to Embodiment 5]

The air-conditioning apparatus 200*e* according to Embodiment 5 offers the following advantages in addition to the advantages offered by the air-conditioning apparatuses according to Embodiments 1 and 2. Since the air-conditioning apparatus 200*e* according to Embodiment 5 can control the amount of gas refrigerant to be supplied from the compressor 1 to the refrigerant circuit on the basis of an indoor air temperature, the apparatus can control the capacity of the compressor 1 without stopping the operation of the compressor 1, thus reducing power consumption.

Since the air-conditioning apparatus 200*e* according to Embodiment 5 can control the capacity of the compressor 1 without stopping the operation of the compressor 1, the frequency of activating and stopping the compressor 1 can accordingly be reduced, thus reducing a load applied to the bearing included in the compressor 1 when the compressor 1 is activated. In other words, the air-conditioning apparatus 200*e* according to Embodiment 5 can include the compressor 1 that is highly reliable.

Embodiment 6

Figure 16:
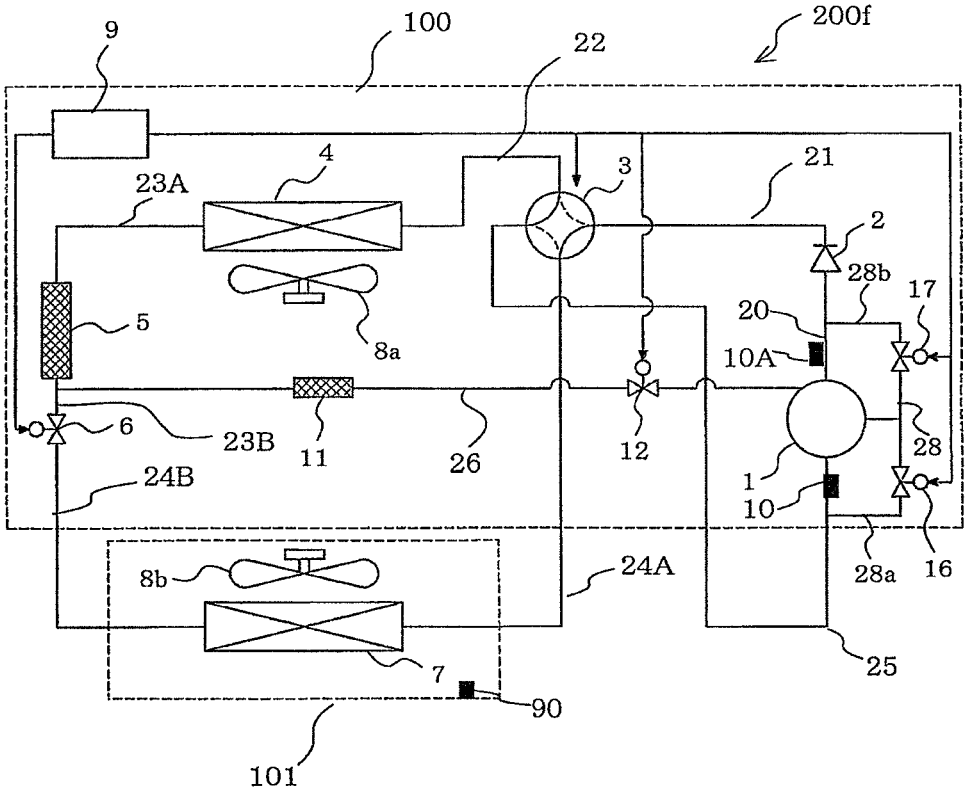
FIG. 16 illustrates an exemplary configuration of a refrigerant circuit of an air-conditioning apparatus according to Embodiment 6 of the present invention.
Figure 17:
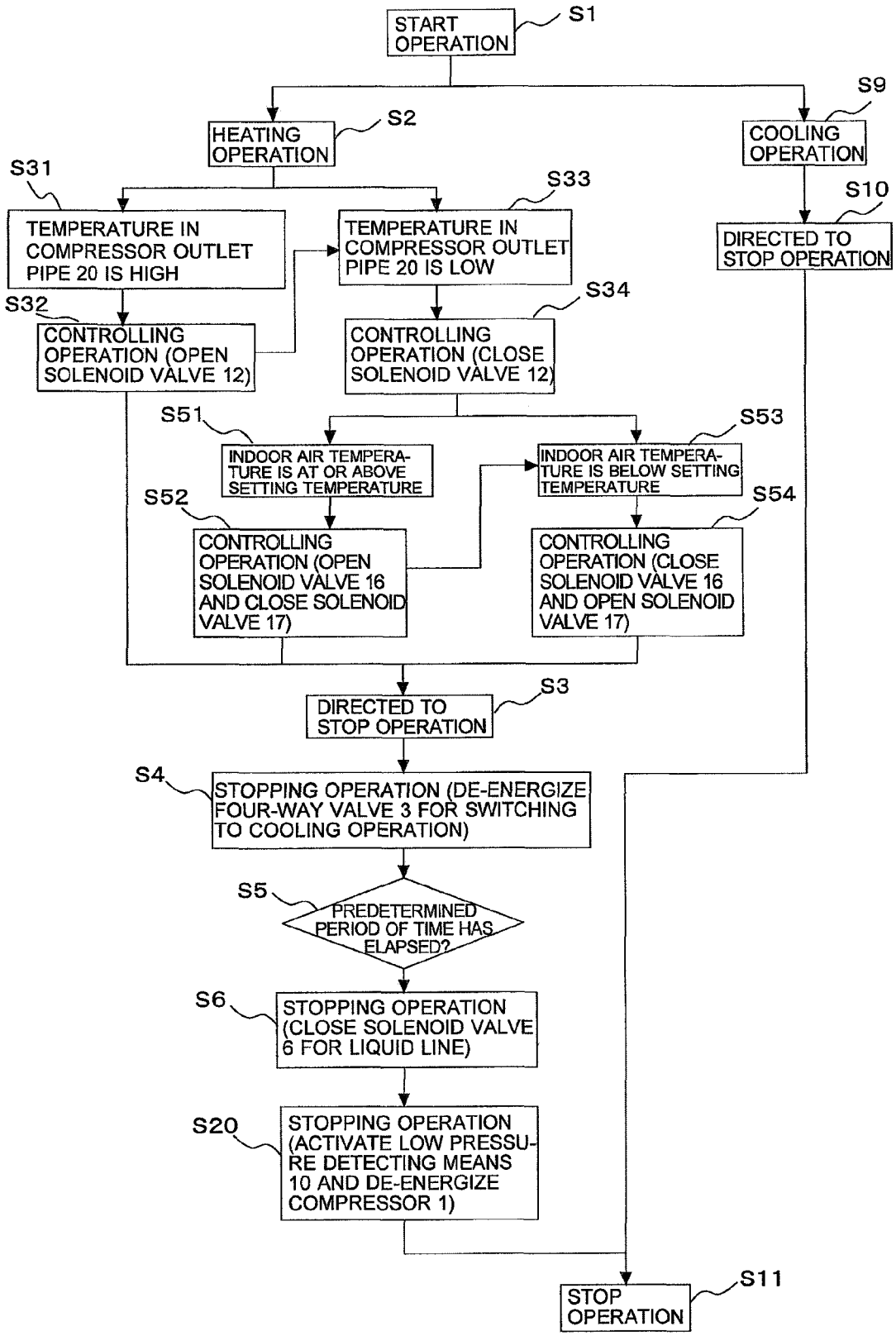
FIG. 17 is a diagram illustrating a flowchart of control for the air-conditioning apparatus according to Embodiment 6 of the present invention.

In Embodiment 6, the same components as those of Embodiments 1 to 5 are designated by the same reference numerals and the difference from Embodiments 1 to 5 will be mainly described. FIG. 16 illustrates an exemplary configuration of a refrigerant circuit of an air-conditioning apparatus 200*f* according to Embodiment 6. FIG. 17 is a diagram illustrating a flowchart of control for the air-conditioning apparatus 200*f* according to Embodiment 6.

Embodiment 6 provides a configuration obtained by combining the configurations in Embodiments 2, 3, and 5. Specifically, the air-conditioning apparatus 200*f* includes the refrigerant pipe 26, the expansion means 11, the solenoid valve 12, and the temperature detecting means 10A in Embodiment 3, and further includes the gas pipe 28*a*, the gas pipe 28*b*, the solenoid valve 16, the solenoid valve 17, the gas pipe 28, and the spring 15 and the valve 14 of the compressor 1 in Embodiment 5. Additionally, although step S3 follows step S34 in Embodiment 3, step S51 or step S53 in Embodiment 5 follows step S34 in Embodiment 6. The flowchart of FIG. 17 will be described mainly with respect to parts peculiar to Embodiment 6.

(Step S2)

To perform the heating operation, the controller 9 controls the driving frequency of the compressor 1, the rotation speed of each of the air-sending devices 8*a* and 8*b*, and the opening degree of the expansion means 5, energizes the solenoid valve coil 3*a* of the four-way valve 3, and opens the solenoid valve 6.

In addition, the controller 9 determines whether a temperature detected by the temperature detecting means 10A is at or above a given temperature.

When determining that the temperature detected by the temperature detecting means 10A is at or above the given temperature, the controller 9 proceeds to step S31.

When determining that the temperature detected by the temperature detecting means 10A is below the given temperature, the controller 9 proceeds to step S33.

(Step S31)

Since the temperature detected by the temperature detecting means 10A is at or above the given temperature, the controller 9 proceeds to step S32.

(Step S32)

The controller 9 opens the solenoid valve 12.

Upon opening the solenoid valve 12, the controller 9 determines whether a temperature detected by the temperature detecting means 10A is at or above the given temperature.

When determining that the temperature detected by the temperature detecting means 10A is at or above the given temperature, the controller 9 proceeds to step S3.

When determining that the temperature detected by the temperature detecting means 10A is below the given temperature, the controller 9 proceeds to step S33.

(Step S33)

Since the temperature detected by the temperature detecting means 10A is below the given temperature, the controller 9 proceeds to step S34.

(Step S34)

The controller 9 closes the solenoid valve 12.

Upon closing the solenoid valve 12, the controller 9 determines whether an indoor air temperature is at or above a given temperature.

When determining that a detected indoor air temperature is at or above the given temperature, the controller 9 proceeds to step S51.

When determining that the detected indoor air temperature is below the given temperature, the controller 9 proceeds to step S53.

(Step S51)

Since the detected indoor air temperature is at or above the given temperature, the controller 9 proceeds to step S52.

(Step S52)

The controller 9 opens the solenoid valve 16 and closes the solenoid valve 17.

Upon opening the solenoid valve 16 and closing the solenoid valve 17, the controller 9 determines whether a detected indoor air temperature is at or above the given temperature.

When determining that the detected indoor air temperature is at or above the given temperature, the controller 9 proceeds to step S3.

When determining that the detected indoor air temperature is below the given temperature, the controller 9 proceeds to step S53.

(Step S53)

Since the detected indoor air temperature is below the given temperature, the controller 9 proceeds to step S54.

(Step S54)

The controller 9 closes the solenoid valve 16 and opens the solenoid valve 17.

[Advantages of Air-Conditioning Apparatus According to Embodiment 6]

The air-conditioning apparatus according to Embodiment 6 offers the same advantages as those offered by the air-conditioning apparatuses according to Embodiments 1 to 5.

Embodiment 7

An air-conditioning apparatus according to Embodiment 7 has the same configuration as that of any of the air-conditioning apparatuses 200 and 200*b* to 200*f* according to Embodiments 1 to 6 and is capable of performing a defrosting operation as control.

Specifically, the air-conditioning apparatus according to Embodiment 7 can perform the defrosting operation by performing processing in step S4 in FIGS. 6, 8, 10, 12, 15, and 17 in the following manner.

(Step S4)

The controller 9 stops energizing the solenoid valve coil 3*a* of the four-way valve 3.

This processing in step S4 allows switching from the heating operation to the cooling operation.

Upon stopping energizing the solenoid valve coil 3*a* of the four-way valve 3, the controller 9 stops the operation of each of the air-sending devices 8*a* and 8*b*.

Although frost may accumulate on the outdoor heat exchanger 4 functioning as an evaporator during the heating operation, switching to the cooling operation in step S4 as described above causes a hot gas to be supplied to the outdoor heat exchanger 4, thus removing frost. In this case, since the air-conditioning apparatus according to Embodiment 7 stops the operation of the air-sending device 8*a* in step S4, the supply of cold outdoor air to the outdoor heat exchanger 4 is suppressed, so that frost accumulated on the outdoor heat exchanger 4 can be reliably removed.

In addition, since the operation of the air-sending device 8*b* is also stopped, the supply of air which has received cooling energy through the indoor heat exchanger 7, functioning as an evaporator, into an indoor space is suppressed. This prevents a user from feeling uncomfortable.

[Advantages of Air-Conditioning Apparatus According to Embodiment 7]

The air-conditioning apparatus according to Embodiment 7 offers the following advantages in addition to the advantages offered by the air-conditioning apparatuses according to Embodiments 1 to 6. Specifically, since the air-conditioning apparatus according to Embodiment 7 stops the air-sending device 8*a* when switching from the heating operation to the cooling operation in order to perform the refrigerant stagnation suppression control, frost accumulated on the outdoor heat exchanger 4 can be reliably removed.

Since the air-conditioning apparatus according to Embodiment 7 further stops the air-sending device 8*b* when switching from the heating operation to the cooling operation in order to perform the refrigerant stagnation suppression control, the supply into the indoor spaces of air which has received cooling energy through the indoor heat exchanger 7 functioning as an evaporator is suppressed, thus preventing the user from feeling uncomfortable.

Embodiment 8

An air-conditioning apparatus according to Embodiment 8 is the air-conditioning apparatus according to any of Embodiments 1 to 7 installed on a railway vehicle such that the compressor of the air-conditioning apparatus according to any of Embodiments 1 to 7 is "horizontally mounted" on the railway vehicle.

A railway vehicle, such as a train other than the Shinkansen bullet train, has a limited mounting space and a compressor is accordingly mounted horizontally thereon. Specifically, an air-conditioning apparatus is installed on the roof of a railway vehicle, such as a train, and a compressor is "horizontally mounted" because a mounting space on the roof is limited. Note that "horizontally mounting" means mounting the compressor 1 such that a direction in which, for example, the orbiting scroll (see FIGS. 14A and 14B) slides is substantially perpendicular to a horizontal plane.

In a horizontally mounted compressor, the level of a liquid may suddenly rise due to the stagnation of a refrigerant or the return of a liquid refrigerant to the compressor, so that a fixed scroll lap of a fixed scroll (see FIGS. 14A and 14B) and an orbiting scroll lap of an orbiting scroll may soak in the liquid refrigerant. In other words, the supply of the liquid refrigerant to the fixed scroll lap and the orbiting scroll lap, which are used to compress a gas refrigerant, may result in breakage of the scroll laps.

Typical train operating time per day is about eight hours (depending on operating efficiency). An air-conditioning apparatus is energized through a pantograph during that time and the apparatus is de-energized while a corresponding railway vehicle is subjected to maintenance or stopped. For example, if a crankcase heater for separating a liquid refrigerant and a lubricating oil is attached to the compressor, the heater cannot be used while the air-conditioning apparatus is de-energized because of the maintenance or the like, so that the stagnation of the refrigerant may fail to be suppressed.

[Advantages of Air-Conditioning Apparatus According to Embodiment 8]

The air-conditioning apparatus according to Embodiment 8 can suppress the stagnation of the refrigerant and accordingly protect the fixed scroll lap and the orbiting scroll lap against soaking in the liquid refrigerant, thus preventing breakage of the fixed scroll lap and the orbiting scroll lap caused by the supply of the liquid refrigerant to these scroll laps.

In the air-conditioning apparatus according to Embodiment 8, the refrigerant can be stored in a range including the check valve 2 on the discharge side, the gas pipe 21, the refrigerant passage A of the four-way valve 3, the outdoor pipe 22, the outdoor heat exchanger 4, the liquid pipe 23A, the expansion means 5, the connecting pipe 23B, and the solenoid valve 6. In other words, the air-conditioning apparatus according to Embodiment 8 can suppress returning of the liquid refrigerant to the compressor and accordingly protect the fixed scroll lap and the orbiting scroll lap against soaking in the liquid refrigerant, thus preventing the breakage of the fixed scroll lap and the orbiting scroll lap caused by the supply of the liquid refrigerant to these scroll laps.

Since the air-conditioning apparatus according to Embodiment 8 can suppress the stagnation of the refrigerant if a crankcase heater cannot be used while power supply through the pantograph is stopped, the fixed scroll lap and the orbiting scroll lap can be protected against soaking in the liquid refrigerant, thus preventing the breakage of the fixed scroll lap and the orbiting scroll lap caused by the supply of the liquid refrigerant to these scroll laps.

It is needless to say that the crankcase heater may be eliminated from the air-conditioning apparatus according to Embodiment 8 because the apparatus can suppress the stagnation of the refrigerant.

The invention claimed is:

1. An air-conditioning apparatus that includes a compressor, a four-way valve, an outdoor heat exchanger, expansion means, and an indoor heat exchanger which are connected by refrigerant pipes to provide a refrigeration cycle, the air-conditioning apparatus comprising:

a check valve disposed between a discharge side of the compressor and the four-way valve:

a first solenoid valve disposed between the expansion means and the indoor heat exchanger and being controllable to open and close;

second temperature detecting means for detecting the temperature of an air-conditioning target space;

a second gas pipe that connects the discharge side of the compressor, the suction side of the compressor, and the inside of the compressor;

a fourth solenoid valve that allows switching between connecting the discharge side and the inside of the compressor and connecting the suction side and the inside of the compressor; and a controller that switches the four-way valve, switches the first solenoid valve between open and closed states, and switches the fourth solenoid valve between open and closed states, wherein the compressor includes:

a sealed container in which the refrigerant supplied from the suction side of the compressor is stored, a fixed scroll disposed in the sealed container, the fixed scroll having a fixed scroll lap, and an orbiting scroll disposed in the sealed container, the orbiting scroll having an orbiting scroll lap on an upper surface thereof, the orbiting scroll lap corresponding to the fixed scroll lap, wherein the fixed scroll includes:

a refrigerant discharge passage through which the refrigerant compressed by the fixed scroll and the orbiting scroll flows into the sealed container, and opening and closing means, disposed at an end of the second gas pipe, for opening or closing the refrigerant discharge passage depending on the pressure of the refrigerant supplied through the second gas pipe, and wherein when a heating operation is stopped, the controller switches the four-way valve from a connection for the heating operation to a connection for a cooling operation, then closes the first solenoid valve, and then stops the compressor.

2. The air-conditioning apparatus of claim 1, further comprising:

low pressure detecting means for detecting the pressure of a refrigerant flowing between a suction side of the compressor and the four-way valve, wherein the controller switches the four-way valve from the connection for the heating operation to the connection for the cooling operation and closes the first solenoid valve, and wherein when a pressure detected by the low pressure detecting means is at or below a given pressure, the controller stops the compressor.

3. The air-conditioning apparatus of claim 1, further comprising:

first temperature detecting means for detecting the temperature of the refrigerant flowing between the discharge side of the compressor and the four-way valve;

a refrigerant pipe that connects the compressor and a point between the expansion means and the first solenoid valve; and a second solenoid valve disposed in the refrigerant pipe, and being controllable to open and close, wherein when a temperature detected by the first temperature detecting means is at or above a given temperature, the controller opens the second solenoid valve to inject a liquid refrigerant or a two-phase refrigerant into the compressor, and wherein when the temperature detected by the first temperature detecting means is below the given temperature, the controller closes the second solenoid valve.

4. The air-conditioning apparatus of claim 1, wherein when a temperature detected by the second temperature detecting means is below a given temperature, the controller controls the fourth solenoid valve to close the refrigerant discharge passage such that the refrigerant is supplied from the discharge side of the compressor to the opening and closing means, and wherein when the temperature detected by the second temperature detecting means is at or above the given temperature, the controller controls the fourth solenoid valve so as to establish communication between the inside of the compressor and the suction side of the compressor, thereby returning the refrigerant which has flowed through the refrigerant discharge passage into the sealed container to the suction side of the compressor.

5. The air-conditioning apparatus of claim 1, wherein upon closing the second solenoid valve, when a temperature detected by the second temperature detecting means is below a given temperature, the controller controls the fourth solenoid valve to close the refrigerant discharge passage such that the refrigerant is supplied from the discharge side of the compressor to the opening and closing means, and wherein upon closing the second solenoid valve, when the temperature detected by the second temperature detecting means is at or above the given temperature, the controller controls the fourth solenoid valve so as to establish communication between the inside of the compressor and the suction side of the compressor, thereby returning the refrigerant which has flowed through the refrigerant discharge passage into the sealed container to the suction side of the compressor.

6. The air-conditioning apparatus of claim 1, further comprising:

a first air-sending device that supplies air to the indoor heat exchanger; and a second air-sending device that supplies air to the outdoor heat exchanger, wherein the controller switches the four-way valve from the connection for the heating operation to the connection for the cooling operation and stops an operation of the first air-sending device and that of the second air-sending device.

7. A railway vehicle air-conditioning apparatus that is the air-conditioning apparatus of claim 1 installed on a vehicle, wherein the compressor is horizontally mounted.

8. An air-conditioning apparatus that includes a compressor, a four-way valve, an outdoor heat exchanger, expansion means, and an indoor heat exchanger which are connected by refrigerant pipes to provide a refrigeration cycle, the air-conditioning apparatus comprising:

a check valve disposed between a discharge side of the compressor and the four-way valve:

a first solenoid valve disposed between the expansion means and the indoor heat exchanger and being controllable to open and close;

first temperature detecting means for detecting the temperature of the refrigerant flowing between the discharge side of the compressor and the four-way valve;

a refrigerant pipe that connects the compressor and a point between the expansion means and the first solenoid valve;

a second solenoid valve disposed in the refrigerant pipe, and being controllable to open and close;

second temperature detecting means for detecting the temperature of an air-conditioning target space;

a first gas pipe that connects the suction side of the compressor and a point of the refrigerant pipe between the second solenoid valve and the compressor;

a third solenoid valve disposed in the first gas pipe, and being controllable to open and close; and a controller that switches the four-way valve, switches the first solenoid valve between open and closed states, switches the second solenoid valve between open and closed states, and switches the third solenoid valve between open and closed states, wherein when a heating operation is stopped, the controller switches the four-way valve from a connection for the heating operation to a connection for a cooling operation, then closes the first solenoid valve, and then stops the compressor, wherein when a temperature detected by the first temperature detecting means is at or above a given temperature, the controller opens the second solenoid valve to inject a liquid refrigerant or a two-phase refrigerant into the compressor, wherein when the temperature detected by the first temperature detecting means is below the given temperature, the controller closes the second solenoid valve, and wherein upon closing the second solenoid valve, when a temperature detected by the second temperature detecting means is at or above a given temperature, the controller opens the third solenoid valve to return an intermediate-temperature intermediate-pressure refrigerant in the compressor through the refrigerant pipe and the first gas pipe to the suction side of the compressor.

9. The air-conditioning apparatus of claim 8, further comprising:

a first air-sending device that supplies air to the indoor heat exchanger; and a second air-sending device that supplies air to the outdoor heat exchanger, wherein the controller switches the four-way valve from the connection for the heating operation to the connection for the cooling operation and stops an operation of the first air-sending device and that of the second air-sending device.

* * * * *